US011556089B2

(12) United States Patent
Nakano et al.

(10) Patent No.: US 11,556,089 B2
(45) Date of Patent: Jan. 17, 2023

(54) IMAGE FORMING APPARATUS

(71) Applicant: Brother Kogyo Kabushiki Kaisha, Aichi-Ken (JP)

(72) Inventors: Hiroshi Nakano, Nagoya (JP); Masahito Saeki, Nagoya (JP); Kotaro Haruta, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 158 days.

(21) Appl. No.: 17/176,522

(22) Filed: Feb. 16, 2021

(65) Prior Publication Data

US 2021/0165362 A1 Jun. 3, 2021

Related U.S. Application Data

(63) Continuation of application No. 16/456,366, filed on Jun. 28, 2019, now Pat. No. 10,955,791.

(30) Foreign Application Priority Data

Jul. 2, 2018 (JP) ..... JP2018-125904

(51) Int. Cl.
*G03G 21/16* (2006.01)
*G03G 21/18* (2006.01)
*G03G 15/01* (2006.01)

(52) U.S. Cl.
CPC ..... *G03G 21/1676* (2013.01); *G03G 15/0121* (2013.01); *G03G 21/1671* (2013.01);
(Continued)

(58) Field of Classification Search
CPC ..... G03G 15/0121; G03G 21/1671; G03G 21/1676; G03G 21/1647; G03G 21/1814; G03G 21/1857
See application file for complete search history.

(56) References Cited

U.S. PATENT DOCUMENTS 5,933,688 A 8/1999 Suzuki et al.
8,346,126 B2 1/2013 Okabe
(Continued)

FOREIGN PATENT DOCUMENTS

JP H11-015275 A 1/1999
JP 2003-208024 A 7/2003
(Continued)

OTHER PUBLICATIONS

May 10, 2022—(JP) Notice of Reasons for Refusal—App 2018-125904.

*Primary Examiner* — Erika J. Villaluna
(74) *Attorney, Agent, or Firm* — Banner & Witcoff, Ltd.

(57) ABSTRACT

An image forming apparatus, having a first photosensitive drum, a first developing roller, a first shifting member movable between a contacting position and a separating position, a motor, a first joint, a first clutch operable in one of a transmittable condition and a discontinuing condition, a first shifting cam rotatable between a first position, in which the first shifting cam locates the first shifting member at the contacting position, and a second position, in which the first shifting cam locates the first shifting member at the separating position, and a first switching cam rotatable between a third position, in which the first switching cam places the first clutch in the transmittable condition, and a fourth position, in which the first switching cam places the first clutch in the discontinuing condition, alongside the first shifting cam rotating between the first position and the second position, is provided.

8 Claims, 22 Drawing Sheets

(52) U.S. Cl.
CPC ..... *G03G 21/1814* (2013.01); *G03G 21/1857* (2013.01); *G03G 21/1647* (2013.01)

(56) References Cited

U.S. PATENT DOCUMENTS

| | | | | |
|---|---|---|---|---|
| 8,929,771 | B2 | 1/2015 | Hashimoto | |
| 2003/0138270 | A1 | 7/2003 | Matsuoka | |
| 2007/0177899 | A1 | 8/2007 | Kawamura | |
| 2010/0111562 | A1 | 5/2010 | Okabe et al. | |
| 2010/0166453 | A1 | 7/2010 | Okabe | |
| 2011/0026972 | A1 | 2/2011 | Kawamura | |
| 2012/0114376 | A1 | 5/2012 | Kawamura | |
| 2012/0251170 | A1 | 10/2012 | Hashimoto | |
| 2012/0275822 | A1 | 11/2012 | Kawamura | |
| 2013/0084105 | A1* | 4/2013 | Suzuki ..... | G03G 21/1647 399/228 |
| 2013/0101314 | A1 | 4/2013 | Yasuda et al. | |
| 2015/0277261 | A1 | 10/2015 | Suzuki | |
| 2016/0349664 | A1 | 12/2016 | Sawashima | |
| 2018/0136604 | A1 | 5/2018 | Lee et al. | |
| 2019/0072164 | A1 | 3/2019 | Tokoro | |

FOREIGN PATENT DOCUMENTS

| | | | |
|---|---|---|---|
| JP | 2003-280367 | A | 10/2003 |
| JP | 2006-171360 | A | 6/2006 |
| JP | 2006-292868 | A | 10/2006 |
| JP | 2007-213023 | A | 8/2007 |
| JP | 2009-036919 | A | 2/2009 |
| JP | 2010-054836 | A | 3/2010 |
| JP | 2010-107889 | A | 5/2010 |
| JP | 2010-156790 | A | 7/2010 |
| JP | 2012-128017 | A | 7/2012 |
| JP | 2012-212074 | A | 11/2012 |
| JP | 2013-003227 | A | 1/2013 |
| JP | 2013-100896 | A | 5/2013 |
| JP | 2015-191210 | A | 11/2015 |
| JP | 2016-180890 | A | 10/2016 |
| JP | 2016-224418 | A | 12/2016 |
| JP | 2017-181947 | A | 10/2017 |

* cited by examiner

21Y

IMAGE FORMING APPARATUS

CROSS REFERENCE TO RELATED APPLICATION

This application is a continuation of U.S. patent application Ser. No. 16/456,366 filed Jun. 28, 2019 which claims priority from Japanese Patent Application No. 2018-125904, filed on Jul. 2, 2018, the entire subject matter of which is incorporated herein by reference.

BACKGROUND

Technical Field

An aspect of the present disclosure is related to an image forming apparatus.

Related Art

An image forming apparatus having a photosensitive drum, a developing roller, a cam, and a motor is known. The developing roller may be movable between a contacting position, in which the developing roller contacts or abuts the photosensitive drum, and a separated position, in which the developing roller is separated from the photosensitive drum. The cam may move the developing roller between the contacting position and the separated position. The motor may cause the cam to rotate.

SUMMARY

While the cam and the motor may cause the developing roller to move between the contacting position and the separated position, the behaviors of the cam and the motor may not cause the developing roller to stop rotating even when the developing roller is placed at the separated position. In other words, the developing roller may keep rotating in the separated position as well as when in the contacting position.

However, the developing roller being at the separated position is not used for forming an image. Therefore, in order to keep the developing roller from being deteriorated, it may be preferable that the developing roller is suspended from rotating when the developing roller is at the separated position.

The present disclosure is advantageous in that an image forming apparatus, in which rotation of a developing roller is stoppable while the developing roller is separated from a photosensitive drum, is provided.

According to an aspect of the present disclosure, an image forming apparatus having a first photosensitive drum, a first developing roller, a first shifting member, a motor, a first joint, a first clutch, a first shifting cam, and a first switching cam, is provided. The first shifting member is configured to move between a contacting position, in which the first developing roller contacts the first photosensitive drum, and a separating position, in which the first developing roller is separated from the first photosensitive drum. The first joint is configured to transmit a driving force from the motor to the first developing roller. The first joint includes a first joint gear configured to receive the driving force from the motor. The first joint is configured to rotate about a first axis extending in an axial direction by the driving force received by the first joint gear. The first clutch is configured to operate in one of a transmittable condition, in which the first clutch is transmittable of the driving force from the motor to the first joint gear, and a discontinuing condition, in which the first clutch discontinues transmission of the driving force from the motor to the first joint gear. The first shifting cam is configured to move the first shifting member. The first shifting cam is configured to rotate about a second axis extending in the axial direction by the driving force received from the motor. The first shifting cam is configured to rotate between a first position, in which the first shifting cam locates the first shifting member at the contacting position, and a second position, in which the first shifting cam locates the first shifting member at the separating position. The first switching cam is configured to switch the conditions in the first clutch. The first switching cam is configured to rotate about the second axis alongside the first shifting cam. The first switching cam is configured to rotate between a third position, in which the first switching cam places the first clutch in the transmittable condition, and a fourth position, in which the first switching cam places the first clutch in the discontinuing condition. The first switching cam is configured to be located at the third position in a state where the first shifting cam is located at the first position and configured to be located at the fourth position in a state where the first shifting cam is located at the second position.

BRIEF DESCRIPTION OF THE ACCOMPANYING DRAWINGS

Figure 22A:
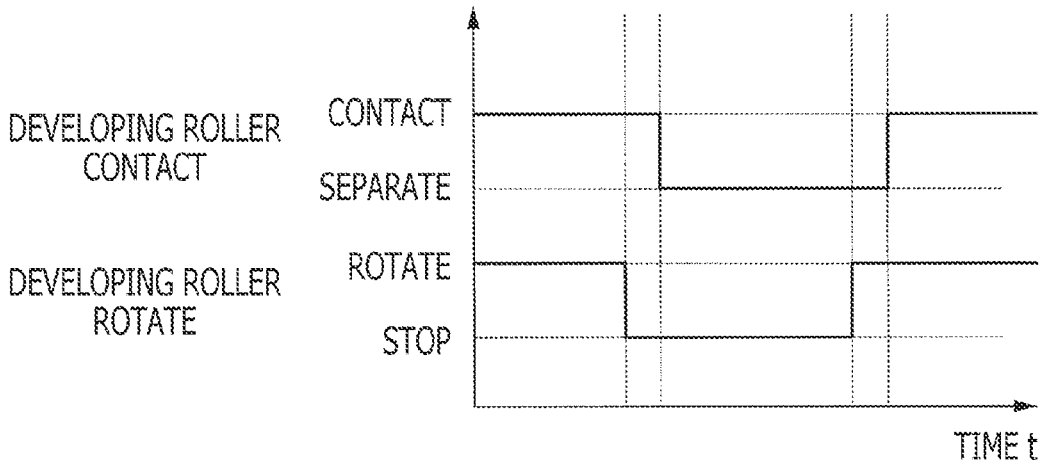
Figure 22B:
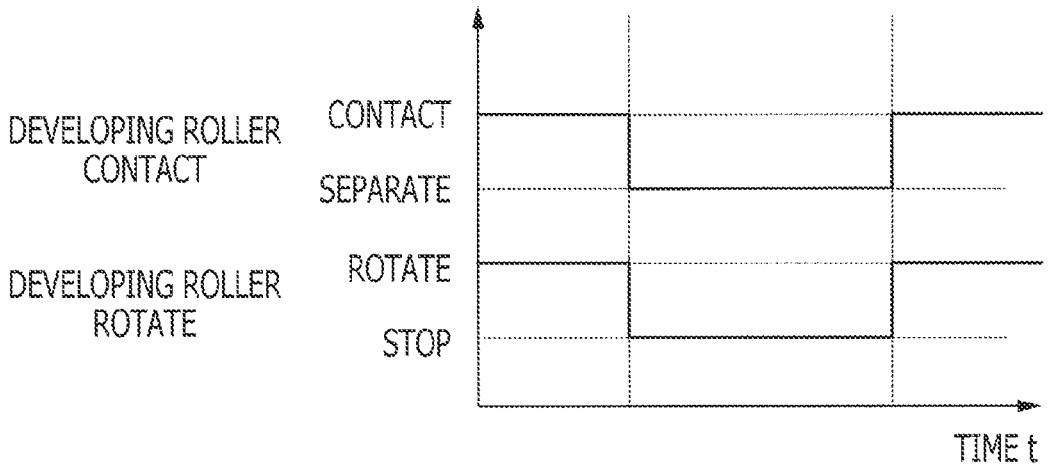

FIG. 22A is a timing chart to illustrate behaviors of the developing roller being activated and deactivated in the image forming apparatus according to a first modified example of the embodiment of the present disclosure. FIG. 22B is a timing chart to illustrate behaviors of the developing roller being activated and deactivated in the image forming apparatus according to a second modified example of the embodiment of the present disclosure.

DETAILED DESCRIPTION

Hereinafter, with reference to the accompanying drawings, described will be embodiments of the present disclosure.

1. Overall Configuration of Image Forming Apparatus

Figure 1:
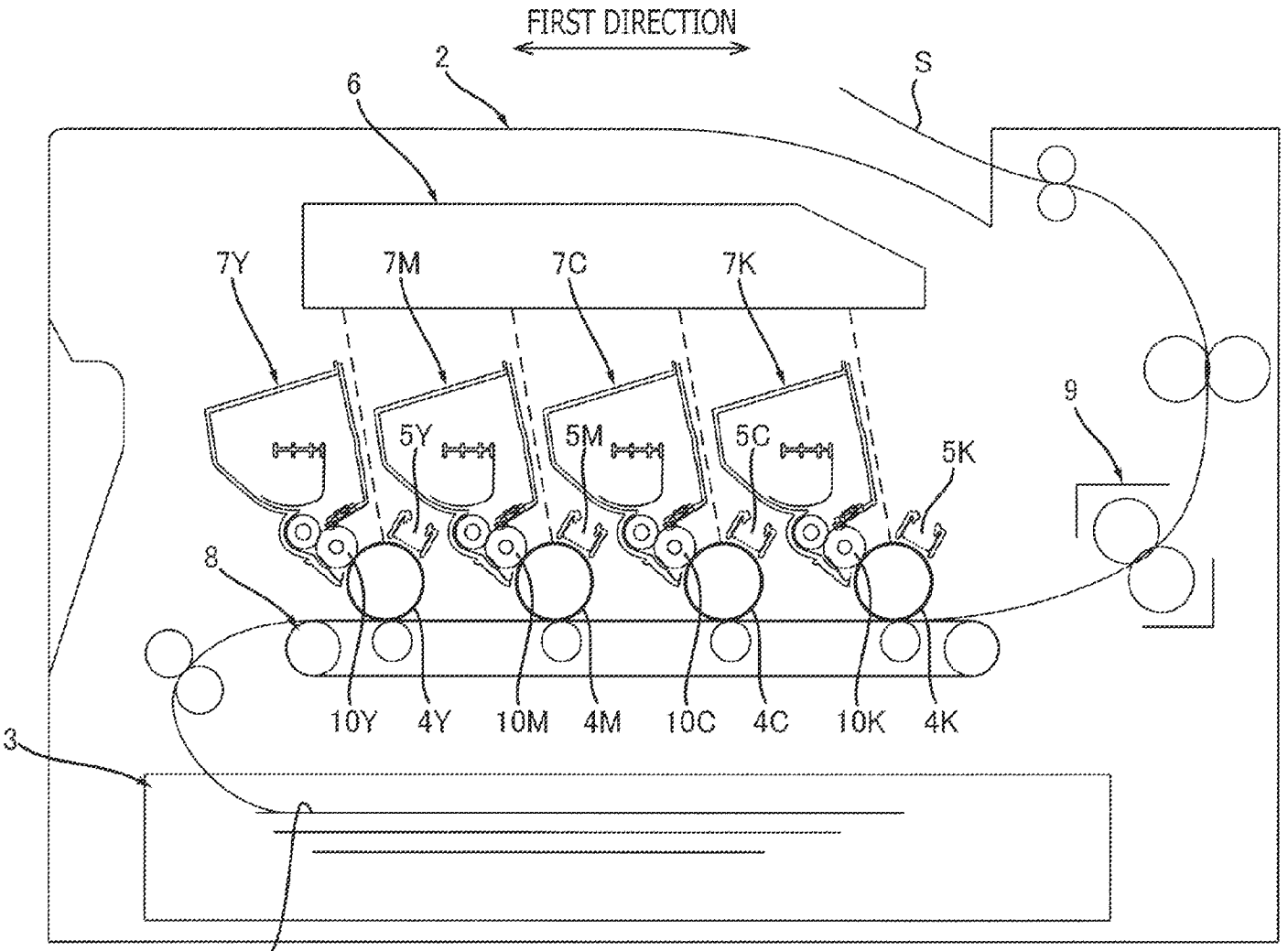
FIG. 1 is an illustrative cross-sectional view of an image forming apparatus according to an embodiment of the present disclosure.
Figure 2:
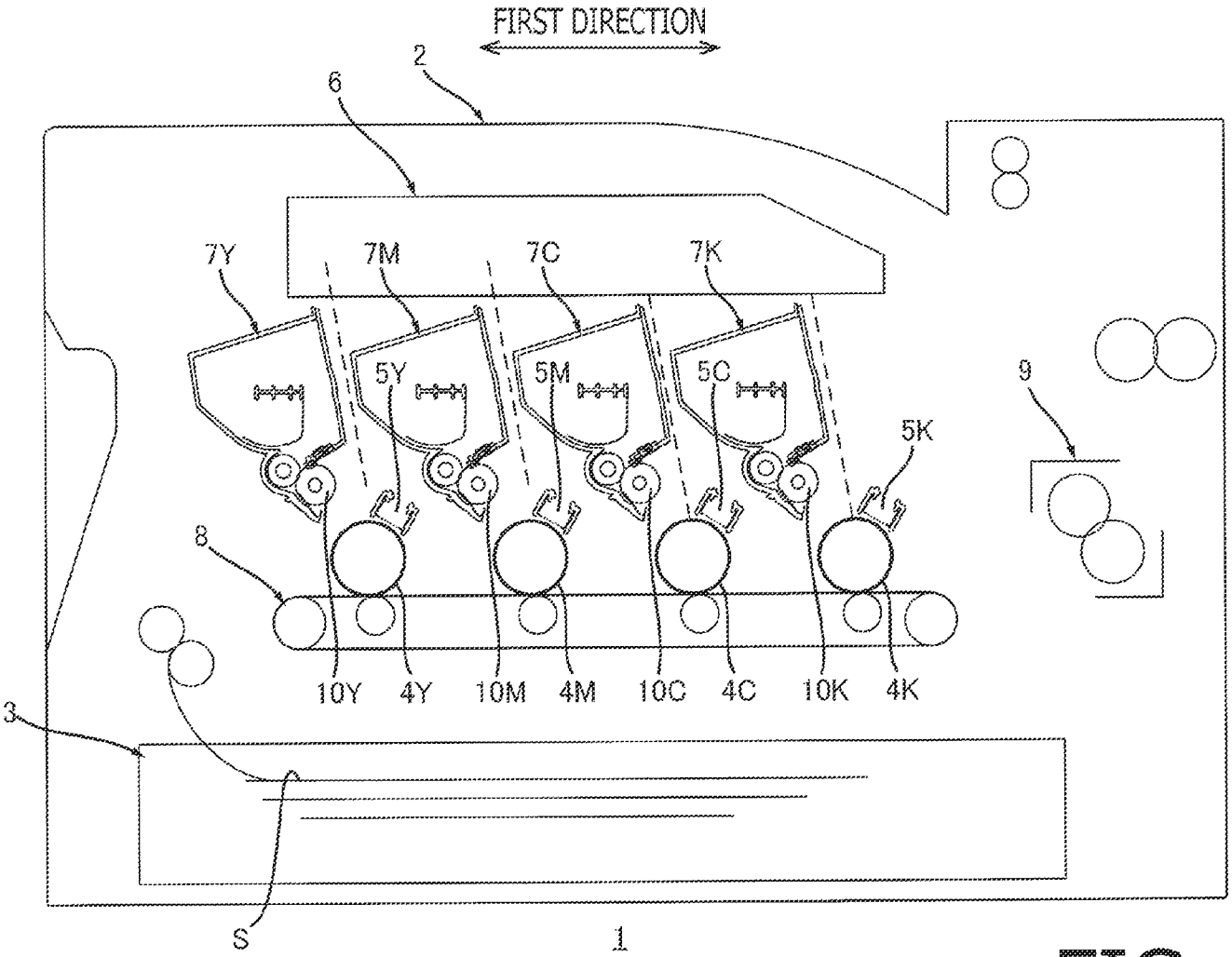
FIG. 2 is an illustrative cross-sectional view of the image forming apparatus, with photosensitive drums being separated from developing rollers, according to the embodiment of the present disclosure.

With reference to FIGS. 1 and 2, described below will be an overall configuration of an image forming apparatus 1. As shown in FIG. 1, the image forming apparatus 1 includes a main casing 2, a feeder tray 3, four (4) photosensitive drums 4Y, 4M, 4C, 4K, four (4) chargers 5Y, 5M, 5C, 5K, an exposure device 6, four (4) developing cartridges 7Y, 7M, 7C, 7K, a transfer device 8, and a fuser 9.

1.1 Main Casing

The main casing 1 may form an exterior shell of the image forming apparatus 1. The main casing 2 accommodates the feeder tray 3, the photosensitive drums 4Y, 4M, 4C, 4K, the chargers 5Y, 5M, 5C, 5K, the exposure device 6, the developing cartridges 7Y, 7M, 7C, 7K, the transfer device 8, and the fuser 9, inside.

1.2 Feeder Tray

The feeder tray 3 may store sheet(s) S therein. The sheet(s) S in the feeder tray 3 may be conveyed toward the photosensitive drum 4Y and onwards. The photosensitive drums 4Y, 4M, 4C, 4K will be described further below in detail.

1.3 Photosensitive Drums

The photosensitive drums 4Y, 4M, 4C, 4K align along a first direction (see, for example, FIG. 1). The photosensitive drums 4Y, 4M, 4C, 4K are each rotatable about a drum axis, which extends in a second direction. The second direction intersects with the first direction. Preferably, the second direction may intersect orthogonally with the first direction. The photosensitive drums 4Y, 4M, 4C, 4K longitudinally extend in the second direction and each has a cylindrical shape.

1.4 Chargers

The charger 5Y may electrically charge a circumferential surface of the photosensitive drum 4Y. The charger 5M may electrically charge a circumferential surface of the photosensitive drum 4M. The charger 5C may electrically charge a circumferential surface of the photosensitive drum 4C. The charger 5K may electrically charge a circumferential surface of the photosensitive drum 4Y. The chargers 5Y, 5M, 5C, 5K are scorotron-typed chargers. Optionally, the chargers 5Y, 5M, 5C, 5K may be charging rollers.

1.5 Exposure Device

The exposure device 6 may expose the photosensitive drum 4Y, of which circumferential surface has been charged by the charger 5Y, to light. As the exposure device 6 emits light at the charged circumferential surface of the photosensitive drum 4Y, an electrostatic latent image may be formed on the circumferential surface of the photosensitive drum 4Y. The exposure device 6 may be a laser scanner unit that may emit a laser beam to scan the circumferential surface of the photosensitive drum 4Y. Optionally, the exposure device 6 may be an LED unit with an LED array. The exposure device 6 may expose the photosensitive drums 4M, 4C, 4K to the light as well.

1.6 Developing Cartridges

The developing cartridge 7Y may store toner therein. The developing cartridge 7Y is detachably attachable to the image forming apparatus 1. The developing cartridge 7Y includes a developing roller 10Y. In other words, the image forming apparatus 1 includes the developing roller 10Y.

The developing roller 10Y is rotatable about a developing-roller axis, which extends in the second direction. The developing roller 10Y longitudinally extends in the second direction and has a cylindrical shape. The developing roller 10Y is partly accommodated in the developing cartridge 7Y and partly exposed outside the developing cartridge 7Y. The developing roller 10Y, when the developing cartridge 7Y is attached to the image forming apparatus 1, contacts the circumferential surface of the photosensitive drum 4Y. The contact between the developing roller 10Y and the photosensitive drum 4Y enables the toner in the developing cartridge 7Y to be supplied to the circumferential surface of the photosensitive drum 4Y. As the developing roller 10Y supplies the toner in the developing cartridge 7Y to the circumferential surface of the photosensitive drum 4Y, the electrostatic latent image is developed into a toner image. In other words, the toner image is formed on the circumferential surface of the photosensitive drum 4Y.

The developing cartridge 7M includes a developing roller 10M, the developing cartridge 7C includes a developing roller 10C, and the developing cartridge 7K includes a developing roller 10K. In other words, the image forming apparatus 1 includes four (4) developing rollers 10Y, 10M, 10C, 10K. The developing roller 10M may supply toner in the developing cartridge 7M to the circumferential surface of the photosensitive drum 4M, the developing roller 10C may supply toner in the developing cartridge 7C to the circumferential surface of the photosensitive drum 4C, and the developing roller 10K may supply toner in the developing cartridge 7K to the circumferential surface of the photosensitive drum 4K.

As will be described further in detail below, the developing cartridge 7Y is, when the developing cartridge 7Y is attached to the image forming apparatus 1, movable between a position, in which the developing roller 10Y contacts the photosensitive drum 4Y (see FIG. 1), and a position, in which the developing roller 10Y is separated from the photosensitive drum 4Y (see FIG. 2). Similarly, the developing cartridge 7M is, when the developing cartridge 7M is attached to the image forming apparatus 1, movable between a position, in which the developing roller 10M contacts the photosensitive drum 4M (see FIG. 1), and a position, in which the developing roller 10M is separated from the photosensitive drum 4M (see FIG. 2). The developing cartridge 7C is, when the developing cartridge 7C is attached to the image forming apparatus 1, movable between a position, in which the developing roller 10C contacts the photosensitive drum 4C (see FIG. 1), and a position, in which the developing roller 10C is separated from the photosensitive drum 4C (see FIG. 2). The developing cartridge 7K is, when the developing cartridge 7K is attached to the image forming apparatus 1, movable between a position, in which the developing roller 10K contacts the photosensitive drum 4K (see FIG. 1), and a position, in which the developing roller 10K is separated from the photosensitive drum 4K (see FIG. 2).

1.7 Transfer Device

The transfer device 8 may transfer the toner images formed on the photosensitive drums 4Y, 4M, 4C, 4K onto the sheet S. The sheet S fed from the feeder tray 3 may be conveyed through an intermediate position between the transfer device 8 and the photosensitive drums 4Y, 4M, 4C, 4K toward the fuser 9 and onward, and meanwhile, the transfer device 8 may transfer the toner images onto the sheet S.

1.8 Fuser

The fuser 9 may apply heat and pressure onto the sheet S, on which the toner images are transferred by the transfer device 8, to fuse and fix the toner images on the sheet S. The sheet S exiting the fuser 9 may be ejected outside the main casing 2 to rest on an upper face of the main casing 2.

2. Detailed Configuration of the Image Forming Apparatus

Figure 3:
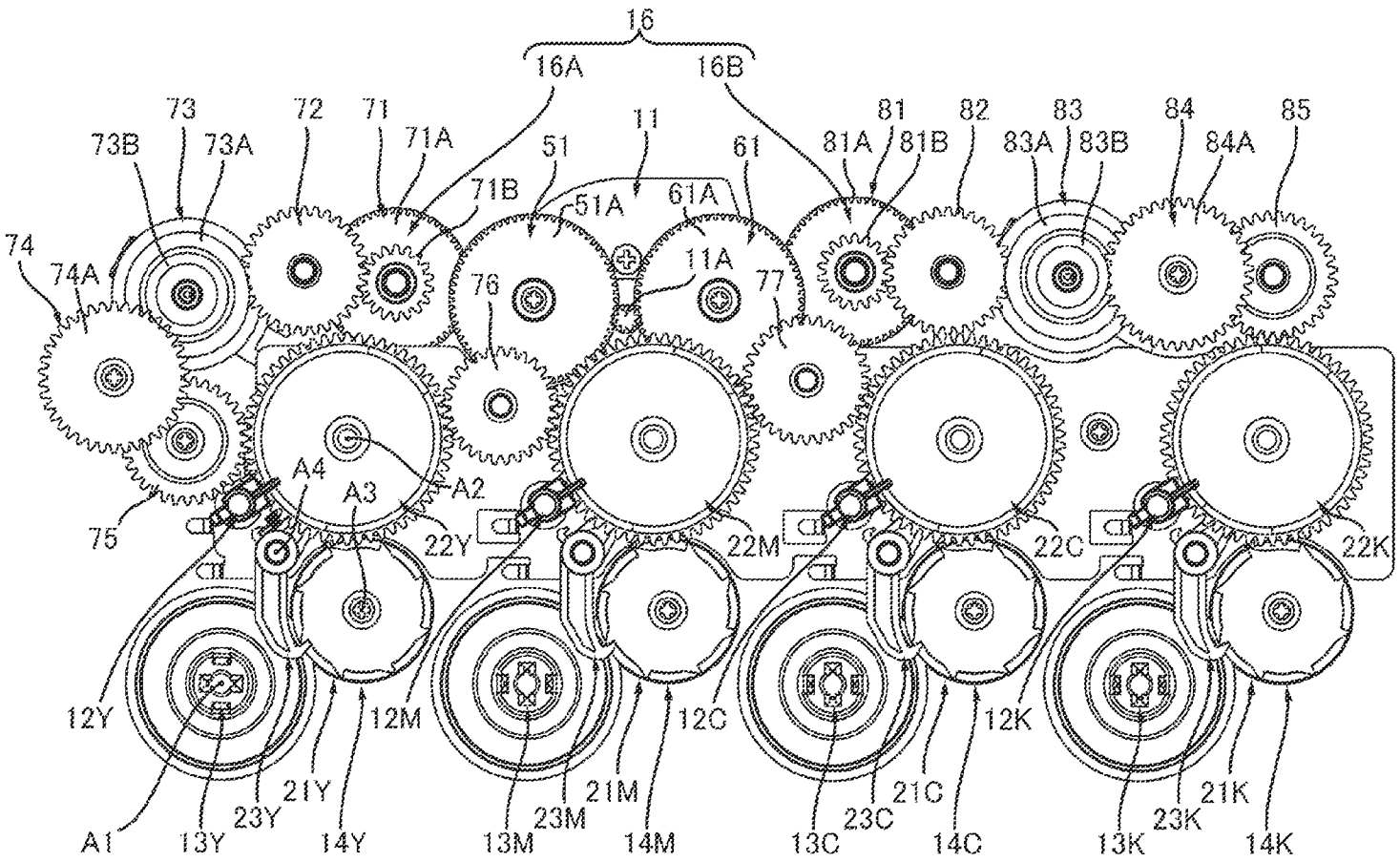
FIG. 3 is an illustrative view of transmission flows of force from a motor to switching assemblies in the image forming apparatus according to the embodiment of the present disclosure.

As shown in FIG. 3, the image forming apparatus 1 includes a motor 11, four (4) shifting members 12Y, 12M, 12C, 12K, four (4) joints 13Y, 13M, 13C, 13K, four (4) clutches 21Y, 21M, 21C, 21K, four (4) levers 23Y, 23M, 23C, 23K, four (4) gears 22Y, 22M, 22C, 22K, a first gear train 15 (see FIG. 4), and a second gear train 16.

2.1 Motor

The motor 11 is arranged inside the main casing 2. Driving force from the motor 11 may be transmitted to the gear 22Y in a switching assembly 14Y, the gear 22M in a switching assembly 14M, the gear 22C in the switching assembly 14C, and the gear 22K in a switching assembly 14K through the second gear train 16.

Figure 4:
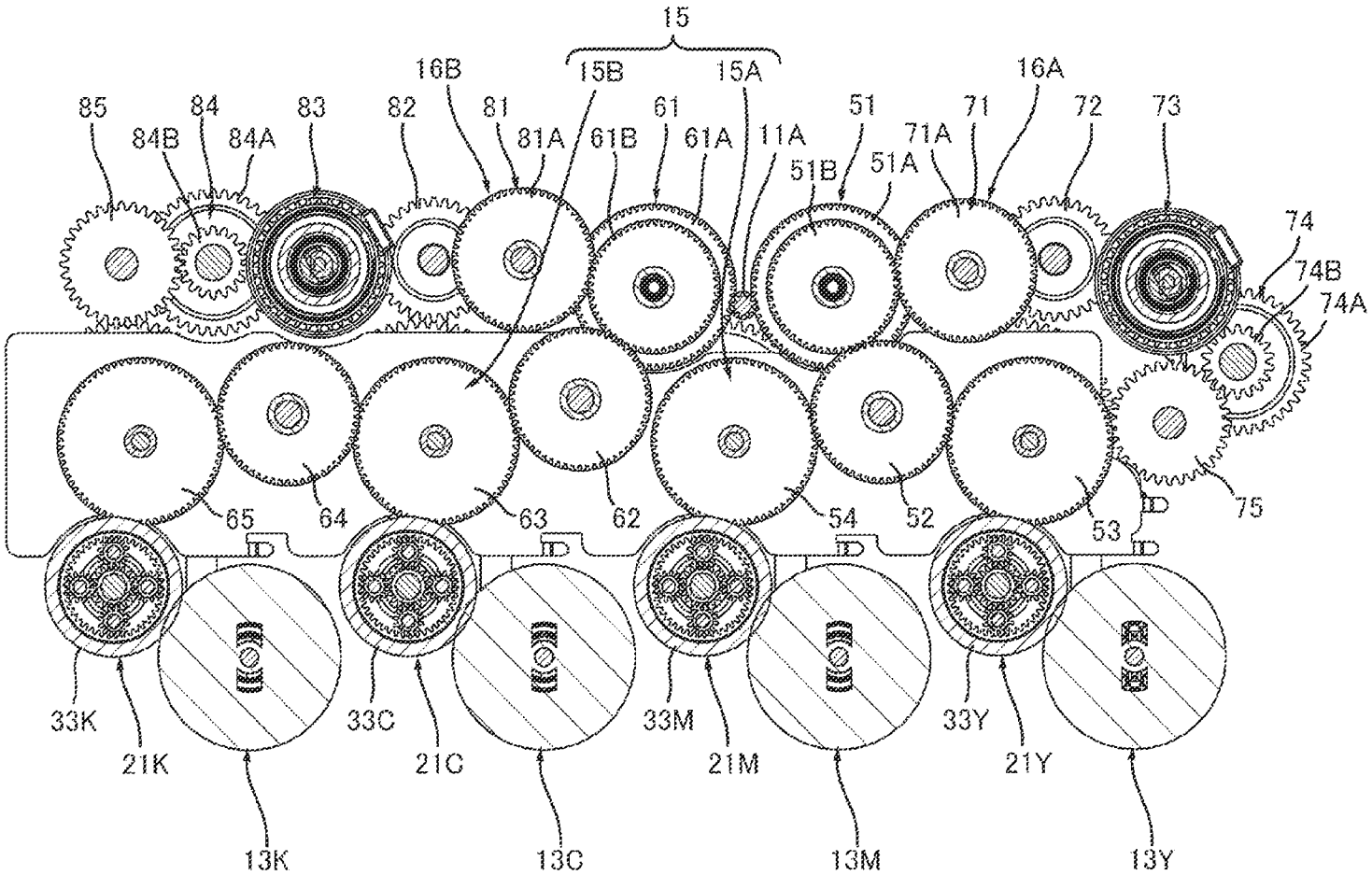
FIG. 4 is an illustrative view of transmission flows of force from the motor to joints in the image forming apparatus according to the embodiment of the present disclosure.

Moreover, as shown in FIG. 4, the driving force from the motor 11 may be transmitted to the joints 13Y, 13M, 13C, 13K through the first gear train 15.

2.2 Shifting Members

Figure 5:
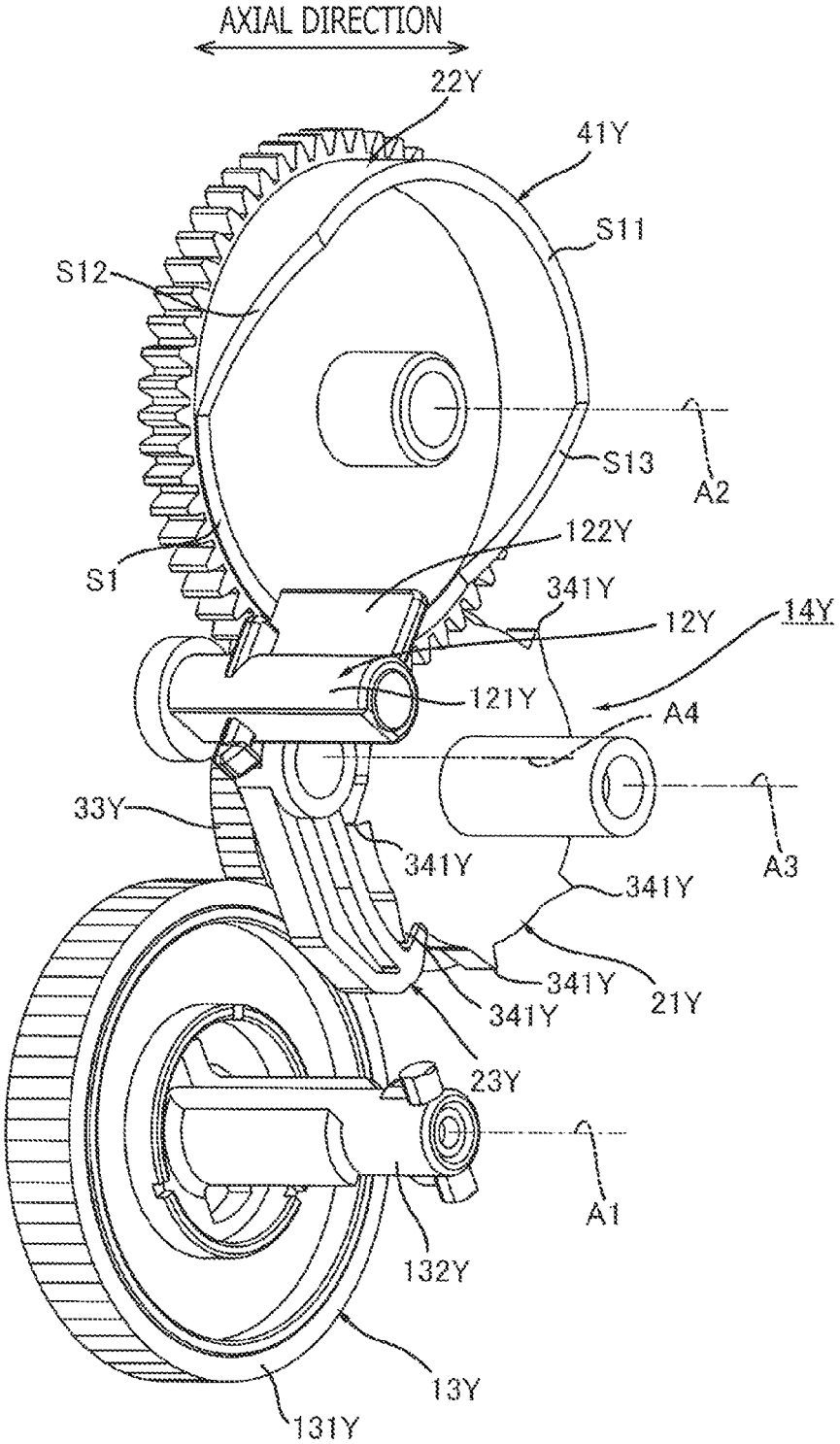
FIG. 5 is a perspective view of the switching assembly being in a first condition in the image forming apparatus according to the embodiment of the present disclosure.
Figure 6:
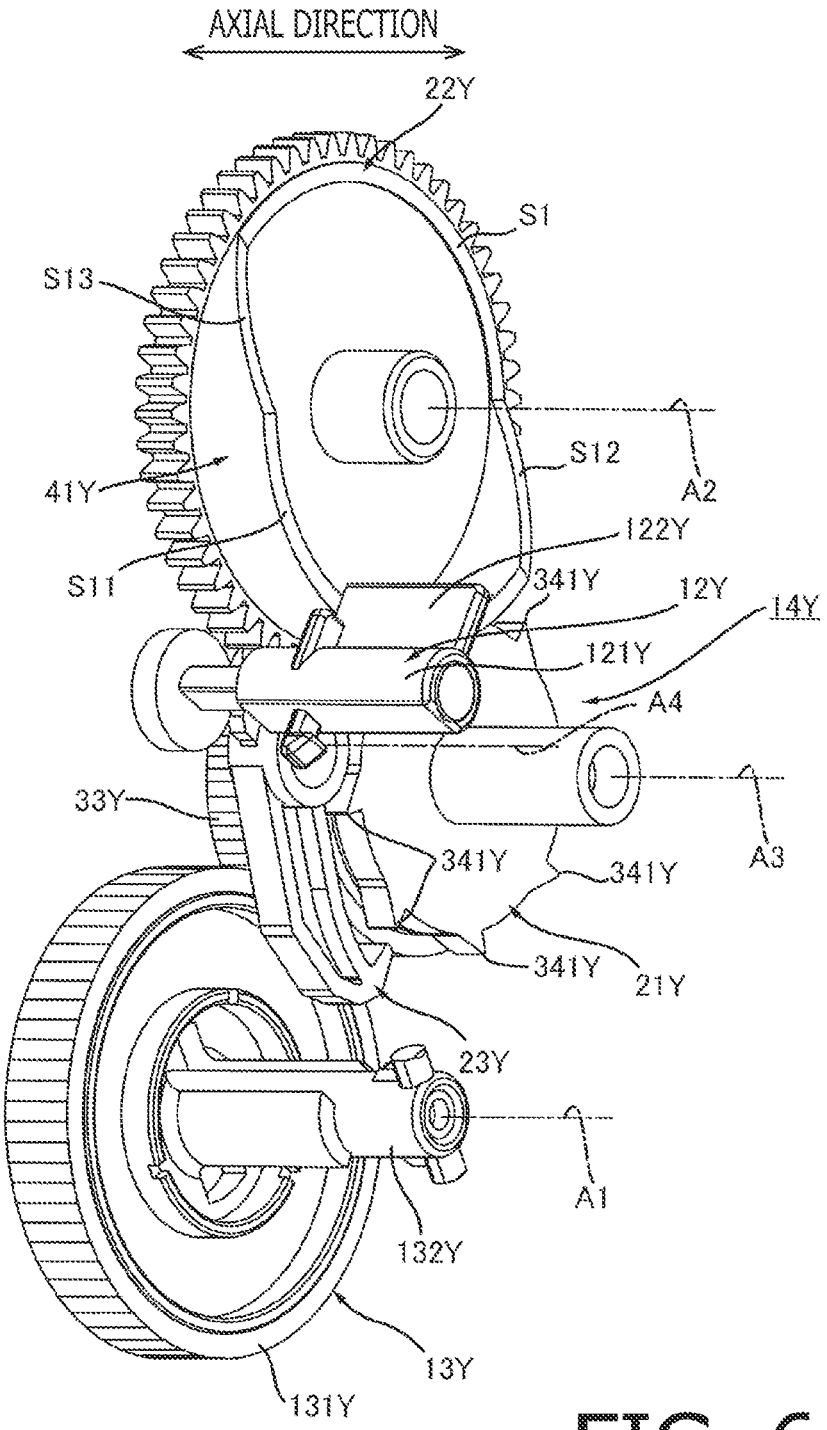
FIG. 6 is a perspective view of the switching assembly being in a second condition in the image forming apparatus according to the embodiment of the present disclosure.

The shifting member 12Y is, as shown in FIGS. 5 and 6, movable between a contacting position (see FIG. 5) and a separating position (see FIG. 6). The shifting member 12Y according to the present embodiment is movable in an axial direction between the contacting position and the separating position. The axial direction is a direction, in which a first axis A1 extends. The first axis A1 will be described further below. The axial direction is a same direction as the second direction.

When the shifting member 12Y is at the contacting position, the shifting member 12Y places the developing roller 10Y (see FIG. 1) to contact the photosensitive drum 4Y (see FIG. 1). In particular, the developing cartridge 7Y (see FIG. 1) in the present embodiment is, when attached to the image forming apparatus 1, urged by a pressing member (not shown) in a direction, in which the developing roller 10Y is urged toward the photosensitive drum 4Y. When the shifting member 12Y is in the contacting position, the shifting member 12Y allows the developing roller 10Y to contact the photosensitive drum 4Y. In other words, the developing roller 10Y is urged by the pressing force of the pressing member to contact the photosensitive drum 4Y.

On the other hand, when the shifting member 12Y is at the separating position, the shifting member 12Y places the developing roller 10Y to be separated from the photosensitive drum 4Y. In particular, when the developing cartridge 7Y is attached to the image forming apparatus 1, and when the shifting member 12Y moves from the contacting position to the separating position, the shifting member 12Y urges the developing cartridge 7Y in a direction, in which the developing roller 10Y separates from the photosensitive drum 4Y, against the pressing force of the pressing member. In other words, when the shifting member 12Y is at the separating position, the shifting member 12Y separates the developing roller 10Y from the photosensitive drum 4Y.

The shifting member 12Y includes a cylindrical portion 121Y and a rib 122Y. The cylindrical portion 121Y extends longitudinally in the axial direction. The cylindrical portion 121Y is supported either directly or indirectly by the main casing 2 and is movable in the axial direction. The rib 122Y is arranged on a circumferential surface of the cylindrical portion 121Y. The rib 122Y protrudes from the circumferential surface of the cylindrical portion 121Y in a radial direction of the cylindrical portion 121Y.

As shown in FIG. 3, each of the shifting members 12M, 12C, 12K has a same structure as the shifting member 12Y and may be described in the same manner as the shifting member 12Y. In other words, the shifting member 12M is movable between a contacting position, in which the developing roller 10M contacts the photosensitive drum 4M, and a separating position, in which the developing roller 10M is separated from the photosensitive drum 4M. The shifting member 12C is movable between a contacting position, in which the developing roller 10C contacts the photosensitive drum 4C, and a separating position, in which the developing roller 10C is separated from the photosensitive drum 4C. The shifting member 12K is movable between a contacting position, in which the developing roller 10K contacts the photosensitive drum 4K, and a separating position, in which the developing roller 10K is separated from the photosensitive drum 4K.

2.3 Joints

The joint 13Y may, when the developing cartridge 7Y is attached to the image forming apparatus 1, and when the shifting member 12Y is at the contacting position, transmit the driving force from the motor 11 to the developing roller 10Y (see FIG. 1). The joint 13Y is rotatable by the driving force from the motor 11 about the first axis A1. As shown in FIGS. 5 and 6, the first axis A1 extends in the axial direction. The joint 13Y includes a joint gear 131Y and a coupling 132Y.

The joint gear 131Y is rotatable about the first axis A1. The joint gear 131Y meshes with a second gear 33Y in the clutch 21Y. Therefore, when the clutch 21Y operates in a transmittable condition, the joint gear 131Y may receive the driving force from the motor 11 through the second gear 33Y.

The coupling 132Y is rotatable integrally with the joint gear 131Y about the first axis A1. The coupling 132Y extends longitudinally in the axial direction and has a cylindrical shape. When the developing cartridge 7Y is attached to the image forming apparatus 1, the coupling 132Y fits with a cartridge coupling (not shown) in the developing cartridge 7Y. The coupling 132Y fitting with the cartridge coupling may rotate about the first axis A1 integrally with the cartridge coupling. Therefore, with the coupling 132Y fitting with the cartridge coupling, the joint 13Y may transmit the driving force that may rotate the developing roller 10Y to the developing roller 10Y. The coupling 132Y is movable relatively to the joint gear 131Y in the axial direction between a position, in which the coupling 132Y fits with the cartridge coupling, and a position, in which the coupling 132Y is separated from the cartridge coupling.

As shown in FIG. 3, each of the joints 13M, 13C, 13K has a same structure as the joint 13Y and may be described in the same manner as the joint 13Y. In other words, the joint 13M may transmit the driving force from the motor 11 to the developing roller 10M, the joint 13C may transmit the driving force from the motor 11 to the developing roller 10C, and the joint 13K may transmit the driving force from the motor 11 to the developing roller 10K.

2.4 Clutch

Figure 8:
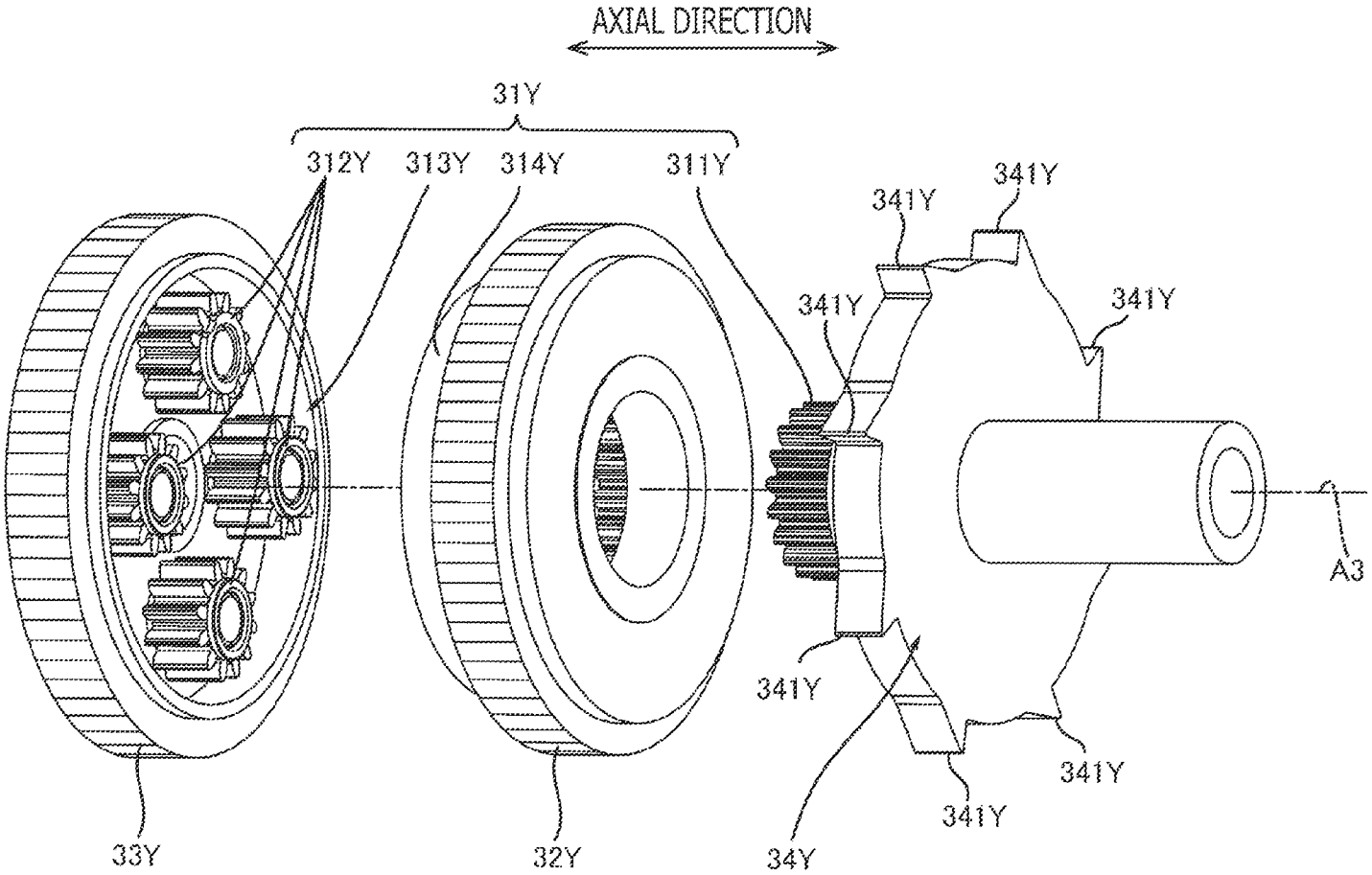
FIG. 8 is an exploded view of a clutch in the image forming apparatus according to the embodiment of the present disclosure.
Figure 9:
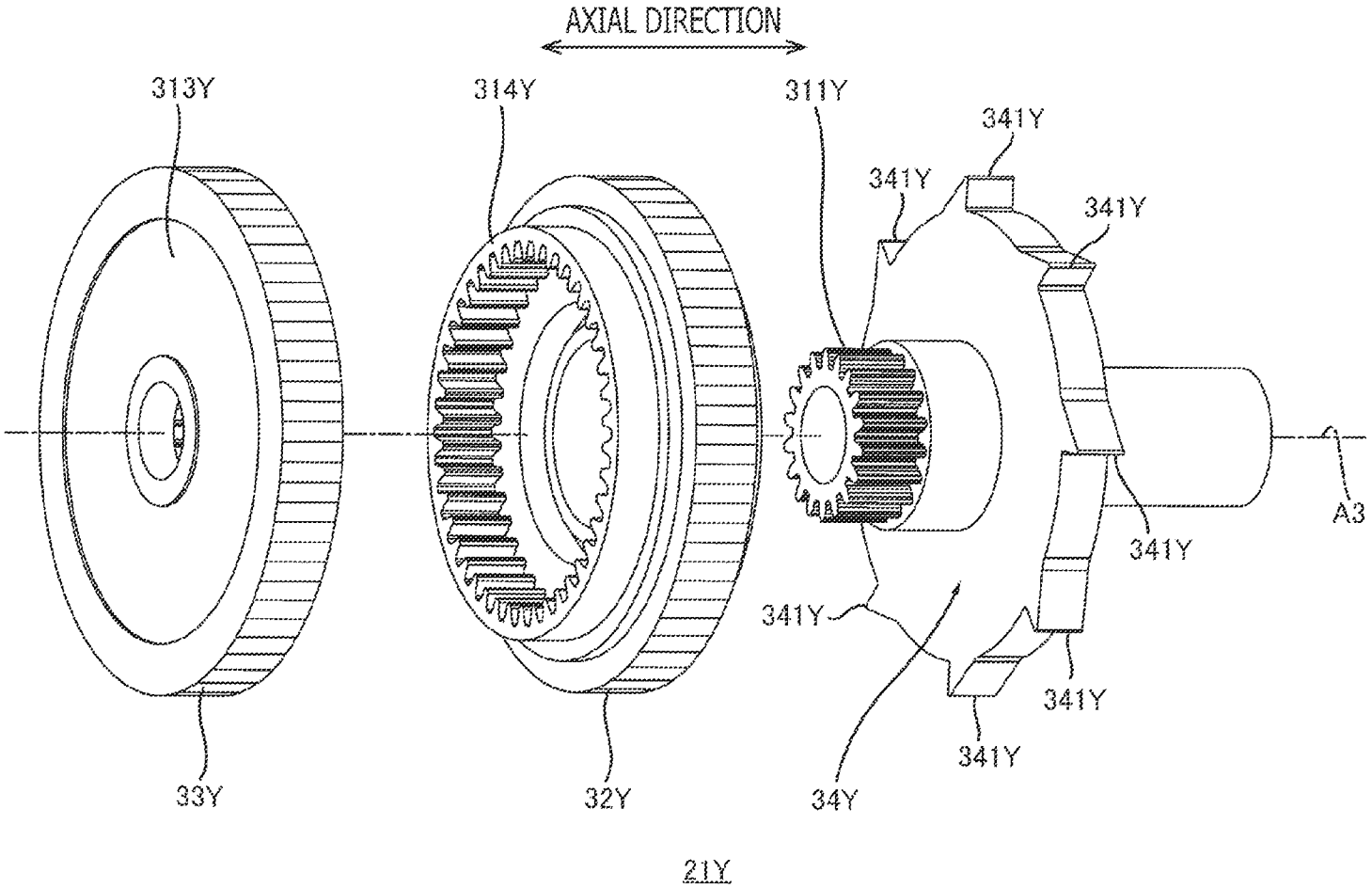
FIG. 9 is another exploded view of the clutch, viewed in a different angle, in the image forming apparatus according to the embodiment of the present disclosure.

The clutch 21Y includes, as shown in FIGS. 8 and 9, a planetary gear assembly 31Y, a first gear 32Y, the second gear 33Y, and a disk 34Y.

The planetary gear assembly 31Y includes a sun gear 311Y, a planet gear 312Y, a planet gear carrier 313Y, and an internal tooth gear 314Y.

The sun gear 311Y is rotatable about a third axis A3, which extends in the axial direction.

The planet gear 312Y may include, as shown in FIG. 8, a plurality of planet gears 312Y. The planet gears 312Y are arranged between the sun gear 311Y and the internal tooth gear 314Y. The planet gears 312Y are arranged to be spaced apart from one another in a circumferential direction. The planet gears 312Y each meshes with the sun gear 311Y and with the internal tooth gear 314Y.

The internal tooth gear 314Y is arranged around and spaced apart from the sun gear 311Y. The internal tooth gear 314Y is rotatable about the third axis A3.

The first gear 32Y and the internal tooth gear 314Y may integrally form a single piece. The first gear 32Y is rotatable about the third axis A3 alongside the internal tooth gear 314Y. Optionally, the first gear 32Y may be formed as a separate piece from the internal tooth gear 314Y and may be fixed to the internal tooth gear 314Y. The first gear 32Y meshes with an idle gear 53 (see FIG. 4) in the first gear train 15. The idle gear 53 will be described further below. The first gear 32Y therefore may rotate alongside the internal tooth 314Y by the driving force transmitted from the motor 11 through the idle gear 53.

Figure 7:
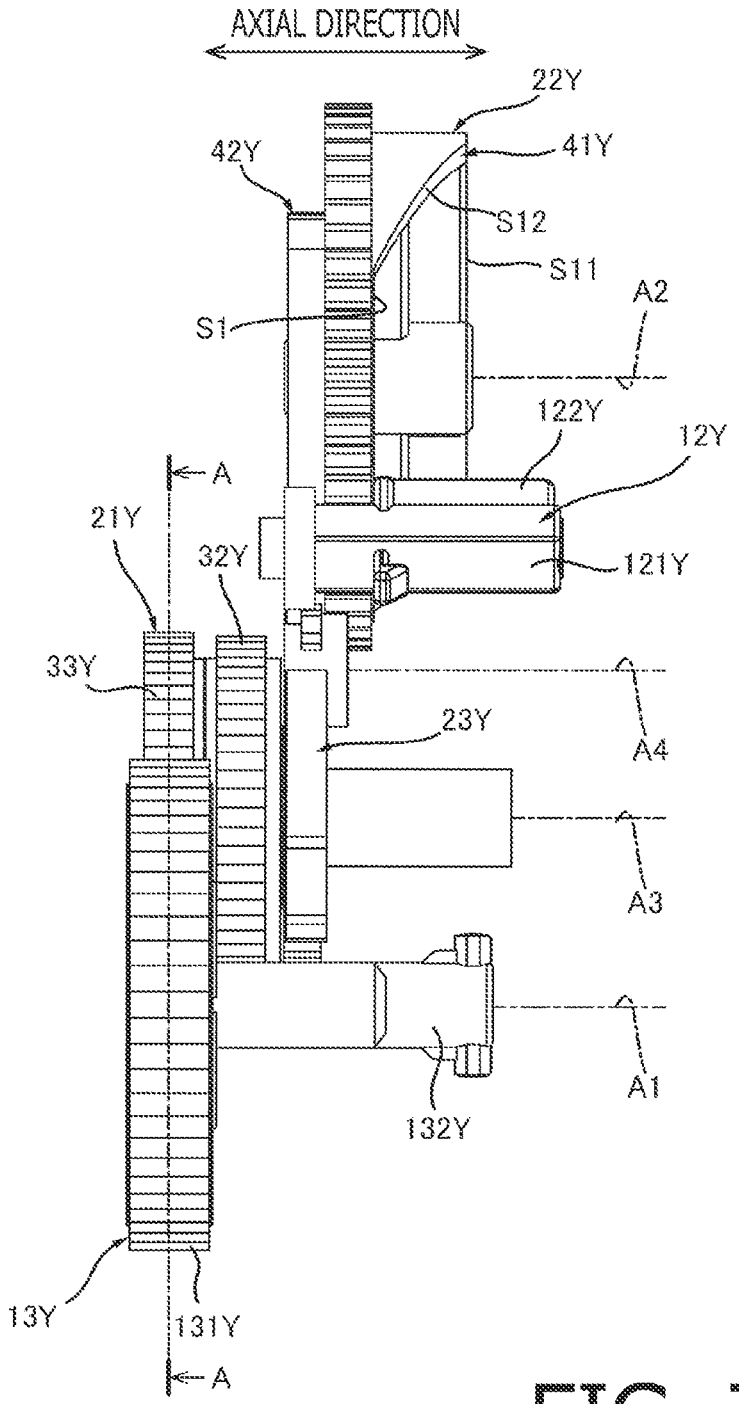
FIG. 7 is a side view of the switching assembly in a view along a direction orthogonal to an axial direction in the image forming apparatus according to the embodiment of the present disclosure.

The second gear 33Y and the planet gear carrier 313Y may integrally form a single piece. The second gear 33Y is rotatable about the third axis A3 alongside the planet gear carrier 313Y. Optionally, the second gear 33Y may be formed as a separate piece from the planet gear carrier 313Y and may be fixed to the planet gear carrier 313Y. The second gear 33Y meshes with the joint gear 131Y (see FIG. 7).

The disk 34Y and the sun gear 311Y may integrally form a single piece. The disk 34Y is rotatable about the third axis A3 alongside the sun gear 311Y. Optionally, the disk 34Y may be formed as a separate piece from the sun gear 311Y and may be fixed to the sun gear 311Y. The disk 34Y has a claw 341Y. The claw 341Y may include a plurality of claws 341Y, which are arranged on a circumferential edge of the disk 34Y. The claws 341Y are spaced apart from one another in a circumferential direction of the disk 34Y. One of the claws 341Y may engage with a lever 23Y (see FIG. 5). With the lever 23Y being engaged with one of the claws 341Y, neither the disk 34Y nor the sun gear 311Y is rotatable. In other words, the disk 34Y and the sun gear 311Y are restricted from rotating. On the other hand, with the lever 23Y being engaged with none of the claws 341Y (see FIG. 6), the disk 34Y and the sun gear 311 are rotatable.

Figure 10A:
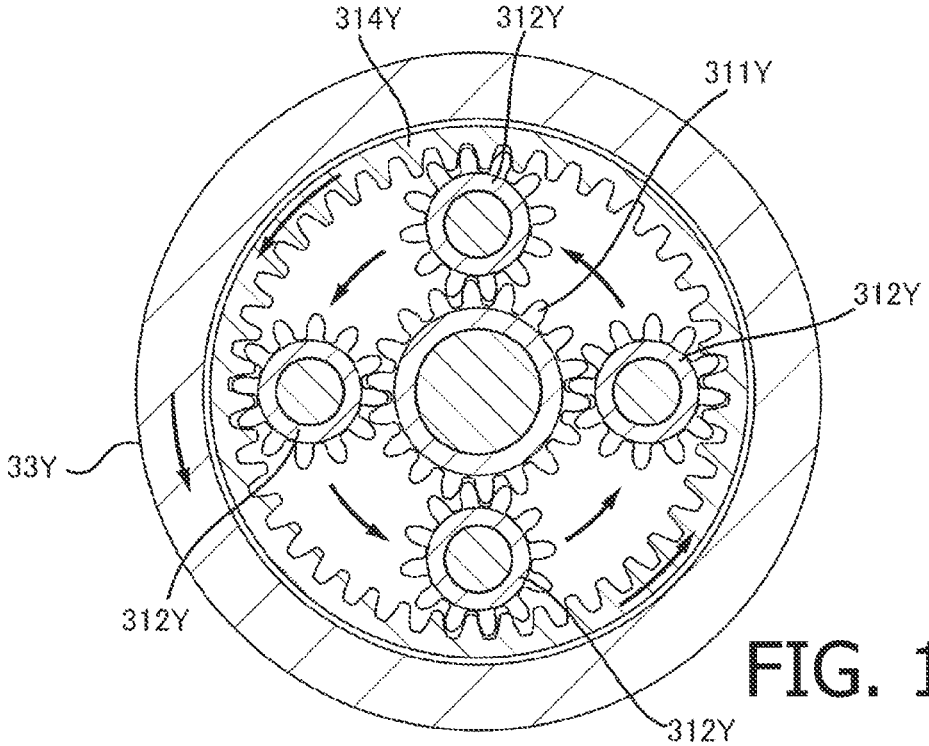
FIG. 10A is an illustrative view of the clutch being in a transmittable condition in the image forming apparatus, taken along a line A-A shown in FIG. 7, according to the embodiment of the present disclosure.

When the disk 34Y and the sun gear 311Y are restricted from rotating, as shown in FIG. 5, the clutch 21Y is transmittable of the driving force from the motor 11. When the joint 13Y is coupled with the cartridge coupling, and the clutch 21Y is in the transmittable condition, and when the driving force from the motor 11 is transmitted to the first gear 32Y, as shown in FIG. 10, the internal tooth gear 314Y rotates while the sun gear 311Y stays still without rotating. Accordingly, the planet gears 312Y revolve around the sun gear 311Y in the same direction as the internal tooth gear 314Y. Therefore, the driving force transmitted to the first gear 32Y is transmitted from the internal tooth gear 314 through the planet gears 312Y to the planet gear carrier 313Y. In this regard, the clutch 21Y may distribute the driving force from the internal tooth gear 314Y to the plurality of planet gears 312Y to be transmitted to the planet gear carrier 313Y. Therefore, in order to enable the clutch 21Y to carry a larger driving force, it may be preferable that the clutch 21Y has a larger quantity of the planet gears 312Y so that the larger driving force may be divided into smaller driving forces to be carried by the larger quantity of the planet gears 312Y. Moreover, in order to restrain fluctuation of intensity of the driving force to be transmitted from the internal tooth gear 314Y to the planet gear carrier 313Y, it may be preferable again that the clutch 21Y has a larger quantity of the planet gears 312Y. For example, the quantity of the planet gears 312Y may be four (4) or more. As the planet gears 312Y revolve in the same direction as the internal tooth gear 314Y around the sun gear 311Y, the planet gear carrier 313Y and the second gear 33Y rotate in the same direction as the internal tooth gear 314Y. In other words, when the clutch 21Y is in the transmittable condition, and when the first gear 32Y rotates, the second gear 33Y rotates alongside the first gear 32Y in the same direction as the second gear 32Y. Therefore, when the clutch 21Y is in the transmittable condition, the clutch 21Y may transmit the driving force from the motor 11 to the joint gear 131Y.

Figure 10B:
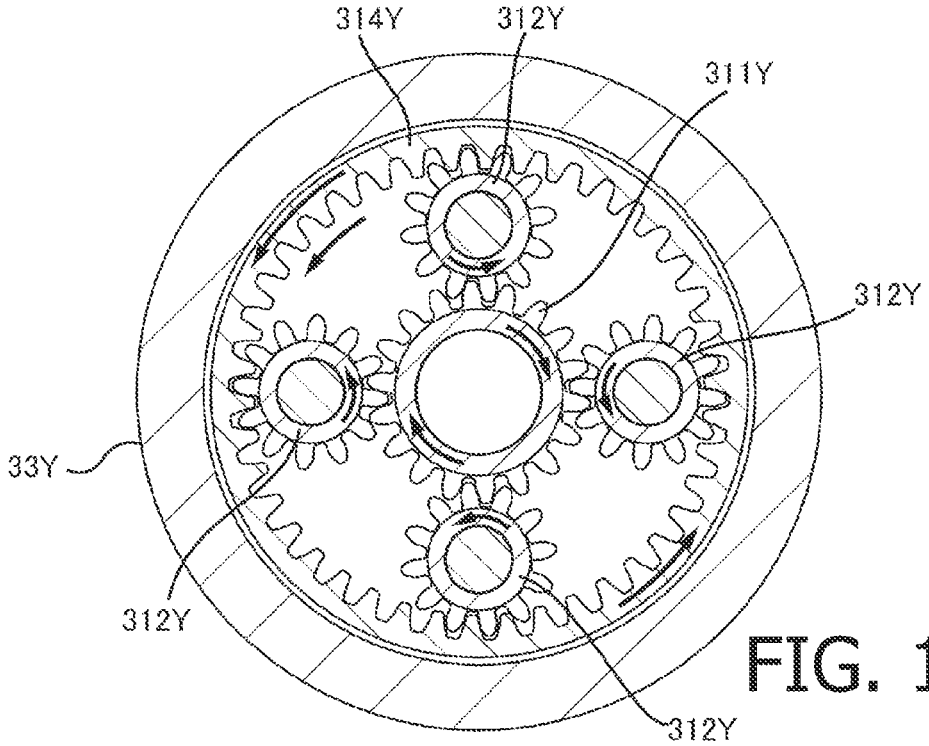
FIG. 10B is an illustrative view of the clutch being in a discontinuing condition in the image forming apparatus according to the embodiment of the present disclosure.

On the other hand, when the disk 34Y and the sun gear 311Y are allowed to rotate, as shown in FIG. 6, the clutch 21Y operates in a discontinuing condition, i.e., in a condition not transmittable of the driving force. When the joint 13Y is coupled with the cartridge coupling, and when the clutch 21Y is in the discontinuing condition, as shown in FIG. 10B, and when the driving force from the motor 11 is transmitted to the first gear 32Y, the internal tooth gear 314Y rotates. Responsively, the sun gear 311Y rotates in a direction opposite to the rotation of the internal tooth gear 314Y while the planet gear carrier 313Y and the second gear 33Y stay still without rotating. In particular, when the joint 13Y is coupled with the cartridge coupling while the clutch 21Y is in the discontinuing condition, and when the driving force from the motor 11 is transmitted to the first gear 32Y, the internal tooth gear 314Y rotates while the second gear 33Y and the planet gear carrier 313Y are restrained from rotating by torque from the joint gear 131Y. Accordingly, the planet gears 312Y rotates, not revolving around the sun gear 311Y, while the sun gear 311Y rotates in the direction opposite to the internal tooth gear 314Y. In other words, when the clutch 21Y is in the discontinuing condition, and while the first gear 32Y rotates, the second gear 33Y stays still without rotating. Therefore, when the clutch 21Y is in the discontinuing condition, the clutch 21Y may absorb and disconnect the transmission of the driving force from the motor 11 to the joint gear 131Y.

As shown in FIG. 3, each of the clutches 21M, 21C, 21K has a same structure as the clutch 21Y and may be described in the same manner as the clutch 21Y. In other words, the clutch 21M is switchable between the transmittable condition, in which the clutch 21M may transmit the driving force from the motor 11 to the joint 13M, and the discontinuing condition, in which the clutch 21M may disconnect the driving force between the motor 11 and the joint 13M. The clutch 21C is switchable between the transmittable condition, in which the clutch 21C may transmit the driving force from the motor 11 to the joint 13C, and the discontinuing condition, in which the clutch 21C may disconnect the driving force between the motor 11 and the joint 13C. The clutch 21K is switchable between the transmittable condition, in which the clutch 21K may transmit the driving force from the motor 11 to the joint 13K, and the discontinuing condition, in which the clutch 21K may disconnect the driving force between the motor 11 and the joint 13K.

2.5 Levers

The lever 23Y is, as shown in FIGS. 5 and 6, movable between an engaged position (see FIG. 5) and a disengaged position (see FIG. 6). The lever 23Y is pivotable between the engaged position and the disengaged position about a fourth axis A4. The lever 23Y is urged by a spring (not shown) in a direction from the disengaged position toward the engaged position.

Figure 11:
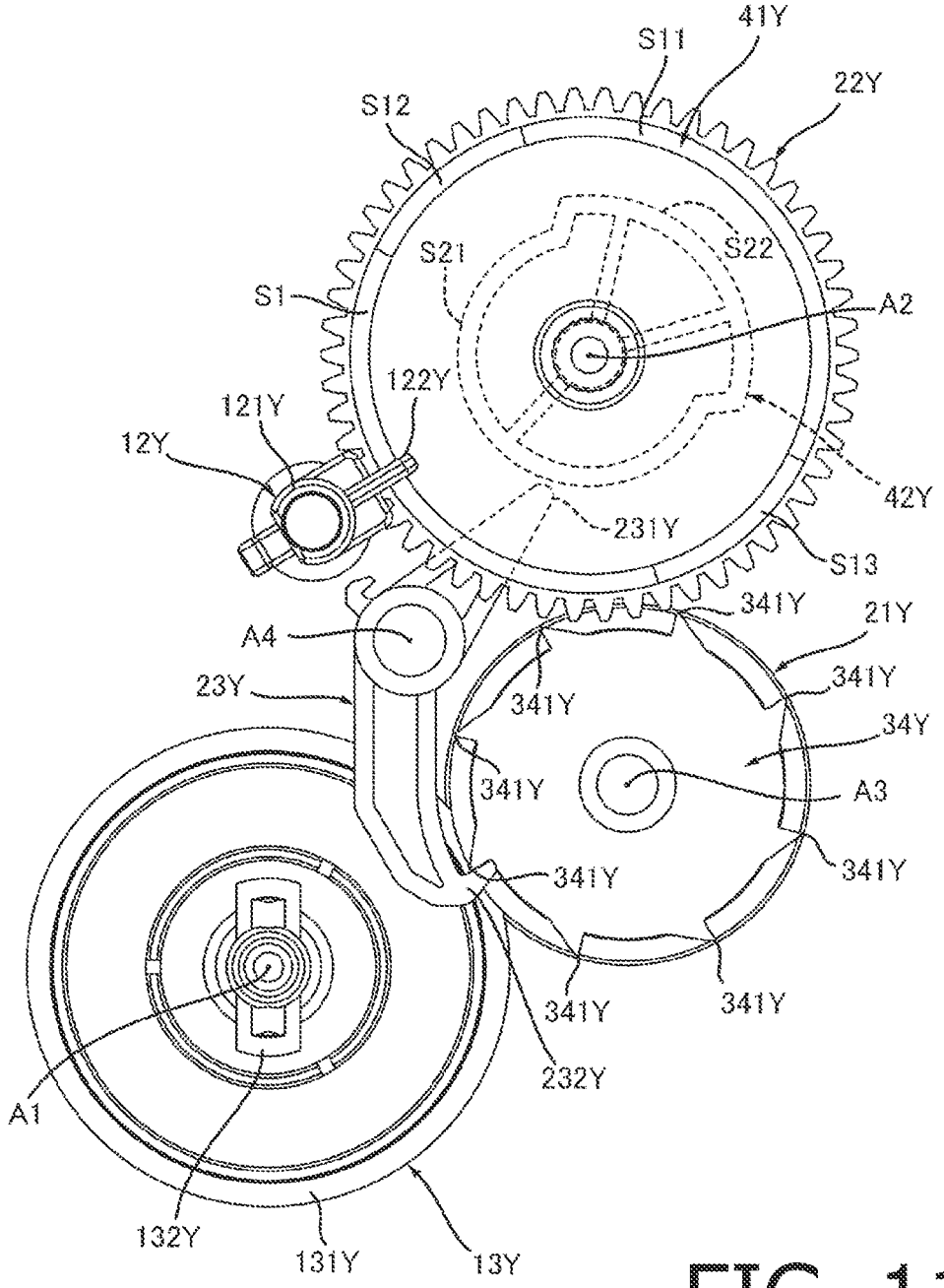
FIG. 11 is a side view of the switching assembly being in the first condition viewed along the axial direction in the image forming apparatus according to the embodiment of the present disclosure.

As shown in FIG. 11, the lever 23Y extends in a direction to intersect with the fourth axis A4. Preferably, the lever 23Y may extend in a direction to intersect orthogonally with the fourth axis A4. The lever 23Y includes a first end 231Y and a second end 232Y. The first end 231Y is, when the lever 23Y is at the engaged position, located between the fourth axis A4 and a switching cam 42Y. The switching cam 42Y will be described further below. The second end 232Y is located at a position different from the first end 231Y in a pivoting direction of the lever 23Y. The second end 232Y has a form of a hook.

When the lever 23Y is at the engaged position, the second end 232Y is engaged with one of the claws 341 in the clutch 21Y. In other words, when the lever 23Y is at the engaged position, the lever 23Y is engaged with one of the claws 341Y. Therefore, when the lever 23Y is at the engaged position, the disk 34Y and the sun gear 311Y are disabled to rotate. In other words, when the lever 23Y is at the engaged position, the clutch 21Y is in the transmittable condition.

Figure 12:
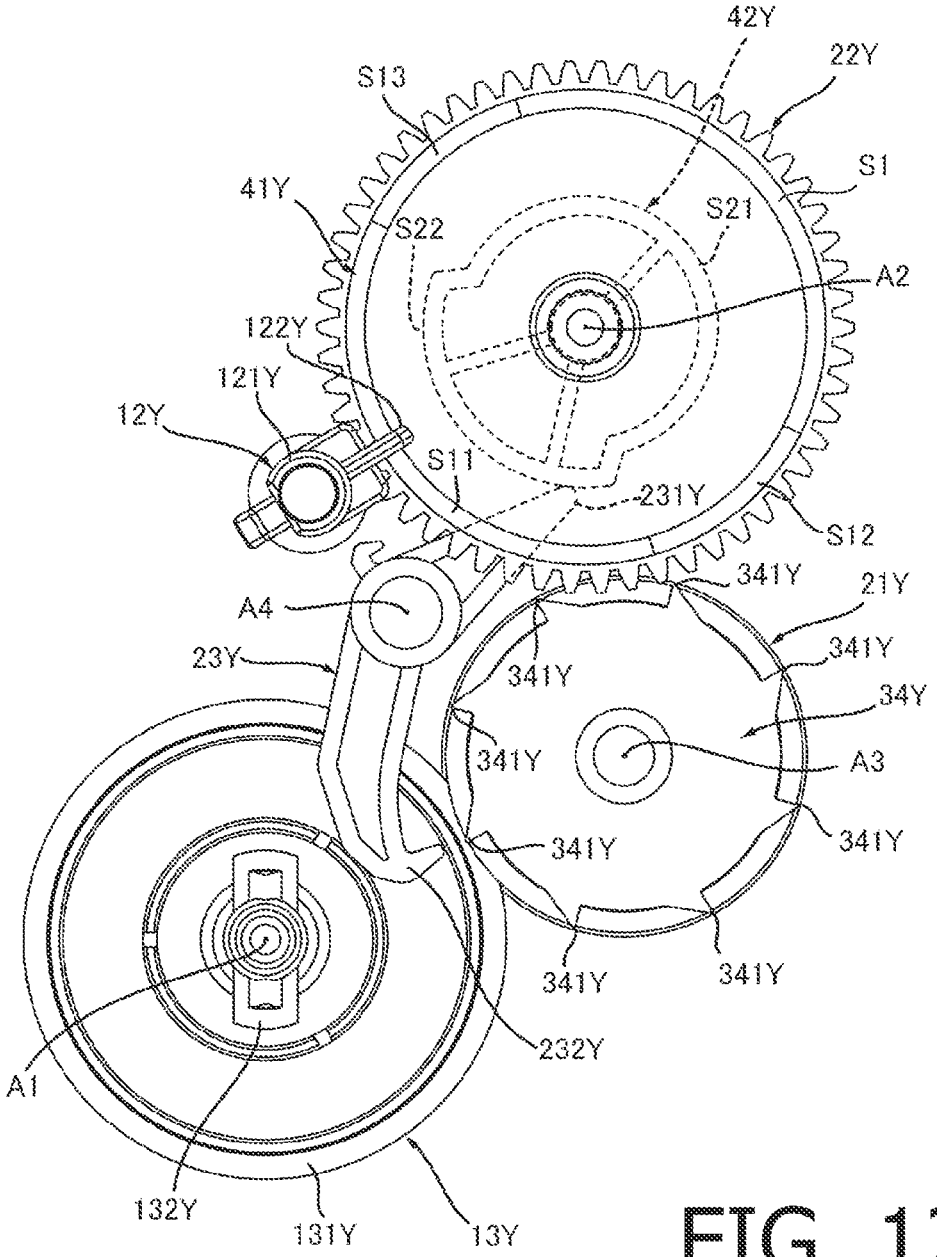
FIG. 12 is a side view of the switching assembly being in the second condition viewed along the axial direction in the image forming apparatus according to the embodiment of the present disclosure.

On the other hand, when the lever 23Y is at the disengaged position, as shown in FIG. 12, the second end 232Y is separated from any of the claws 341Y in the clutch 21Y. In other words, when the lever 23Y is in the disengaged position, the lever 23Y is disengaged from the claws 341Y. Therefore, the disk 34Y and the sun gear 311Y are allowed to rotate. In other words, when the lever 23Y is in the disengaged position, the clutch 21Y is in the discontinuing condition.

As shown in FIG. 3, each of the lever 23M, 23C, 23K has a same structure as the lever 23Y and may be described in the same manner as the lever 23Y.

2.6 Gears

As shown in FIG. 3, the gear 22Y meshes with the idle gear 75, which will be described further below, in the second gear train 16. Therefore, the driving force from the motor 11 may be transmitted to the gear 22Y, and the gear 22Y may rotate about the second axis A2. The second axis A2 extends in the axial direction. The gear 22Y is arranged not to contact the clutch 21Y.

Figure 13A:
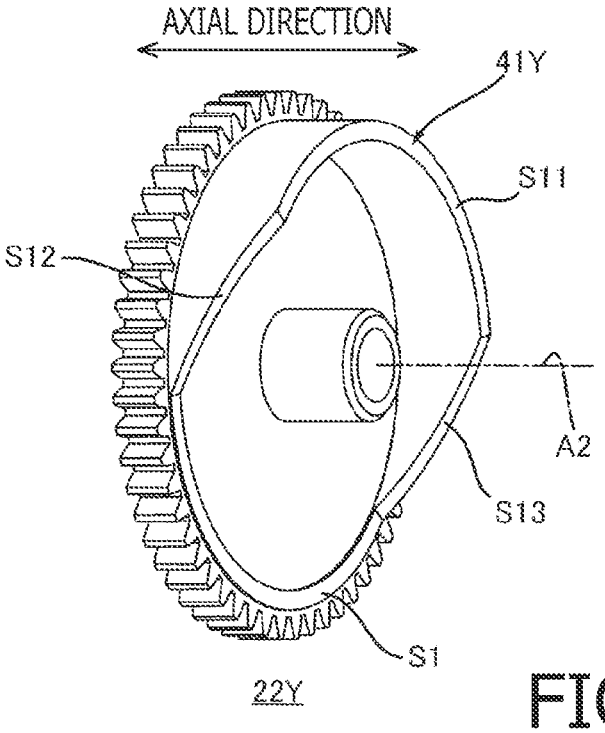
FIG. 13A is a perspective view of a gear having a shifting cam and a switching cam in the image forming apparatus according to the embodiment of the present disclosure.
Figure 13B:
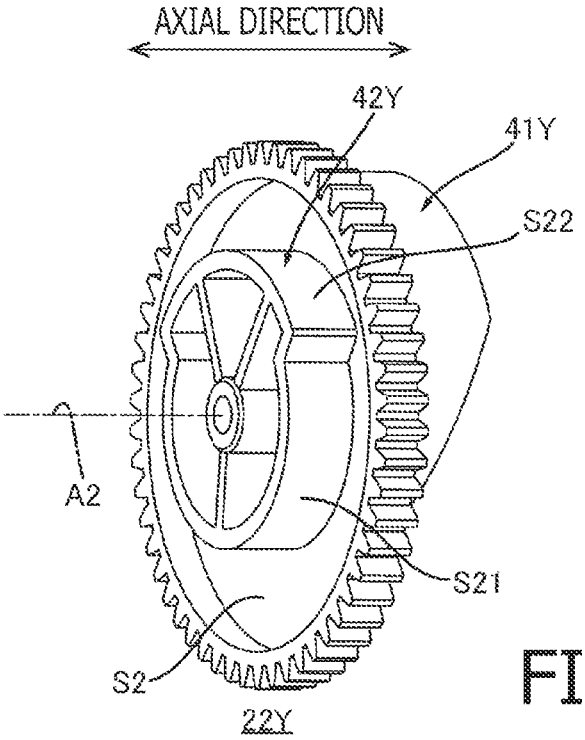
FIG. 13B is another perspective view of the gear, viewed at a different angle, in the image forming apparatus according to the embodiment of the present disclosure.

The gear 22Y includes, as shown in FIGS. 13A and 13B, a shifting cam 41Y (see FIG. 13A) and the switching cam 42Y (see FIG. 13B). In other words, the image forming apparatus 1 includes the shifting cam 41Y and the switching cam 42Y. Specifically, the gear 22Y has a first face S1 (see FIG. 13A) on one side in the axial direction and a second face S2 (see FIG. 13B) on the other side in the axial direction. In other words, the second face S2 is on a side opposite to the first face S1 in the axial direction. The first face S1 and the second face S2 spread in a direction intersecting with the second axis A2. Preferably, the first face S1 and the second face S2 spread in a direction intersecting orthogonally with the second axis A2. The shifting cam 41Y is arranged on the first face S1 of the gear 22Y, and the switching cam 42Y is arranged on the second face S2 of the gear 22Y. The gear 22Y has the shifting cam 41Y and the switching cam 42Y integrally. Therefore, the shifting cam 41Y and the switching cam 42Y may rotate about the second axis A2 as the second gear 22Y rotates. Thus, the shifting cam 41Y may rotate about the second axis A2 as the driving force from the motor 11 is transmitted to the second gear 22Y, and the switching cam 42Y may rotate about the second axis A2 alongside the shifting cam 41Y. Optionally, the shifting cam 41Y and the switching cam 42Y may be formed as separate parts and may be fixed to the gear 22Y.

The shifting cam 41Y protrudes in the axial direction, as shown in FIG. 13A, from the first face S1 of the gear 22Y. The shifting cam 41Y is arranged around the second axis A2 on an edge of the gear 22Y. The shifting cam 41Y extends in a circumferential direction of the gear 22Y. The shifting cam 41Y is arranged on a part of the edge of the gear 22Y along the circumferential direction. The shifting cam 41Y includes a plane face S11, a first oblique face S12, and a second oblique face S13. The plane face S11 is arranged to be apart from the first face S1 of the gear 22Y. The plane face S11 extends in parallel with the first face S1 of the gear 22Y. The first oblique face S12 and the second oblique face S13 are arranged to be apart from each other along the circumferential direction of the gear 22Y across the plane face S11. Each of the first oblique face S12 and the second oblique face S13 is arranged to intervene between the first face S1 of the gear 22Y and an end of the plane face S11 in the circumferential direction. In other words, the first oblique face S12 and the second oblique face S13 each connects the first face S1 of the gear 22Y and the plane face S11. Each of the first oblique face S12 and the second oblique face S13 inclines with respect to the first face S1 of the gear 22Y and the plane face S11.

The switching cam 42Y protrudes in the axial direction, as shown in FIG. 13B, from the second face S2 of the gear 22Y. The switching cam 42Y is arranged around the second axis A2. The switching cam 42Y includes a first circumferential face S21 and a second circumferential face S22. The first circumferential face S21 and the second circumferential face S22 extends in the axial direction and in the circumferential direction of the gear 22Y. The second circumferential face S22 is arranged to be farther than the first circumferential face S21 from the second axis A2 in the radial direction.

As shown in FIG. 3, each of the gears 22M, 22C, 22K has a same structure as the gear 22Y and may be described in the same manner as the gear 22Y. In other words, the gear 22M integrally includes the shifting cam 41M to move the shifting member 12M and the switching cam 42M to switch the conditions of the clutch 21M. The gear 22C integrally includes the shifting cam 41C to move the shifting member 12C and the switching cam 42C to switch the conditions of the clutch 21C. The gear 22K integrally includes the shifting cam 41K to move the shifting member 12K and the switching cam 42K to switch the conditions of the clutch 21K.

The gear 22Y, together with the lever 23Y and the clutch 21Y, forms a part of a switching assembly 14Y. The switching assembly 14Y is operable in one of a first condition, in which the developing roller 10Y is placed to contact the photosensitive drum 4Y and the driving force is transmittable to the developing roller 10Y, and a second condition, in which the developing roller 10Y is separated from the photosensitive drum 4Y and the driving force is not transmittable to the developing roller 10Y. In other words, the condition in the switching assembly 14Y is switchable between the first condition and the second condition.

The gear 22M, together with the lever 23M and the clutch 21M, forms a part of a switching assembly 14M. The switching assembly 14M is operable in one of a first condition, in which the developing roller 10M is placed to contact the photosensitive drum 4M and the driving force is transmittable to the developing roller 10M, and a second condition, in which the developing roller 10M is separated from the photosensitive drum 4M and the driving force is not transmittable to the developing roller 10M. In other words, the condition in the switching assembly 14M is switchable between the first condition and the second condition.

The gear 22C, together with the lever 23C and the clutch 21C, forms a part of a switching assembly 14C. The switching assembly 14C is operable in one of a first condition, in which the developing roller 10C is placed to contact the photosensitive drum 4C and the driving force is transmittable to the developing roller 10C, and in a second condition, in which the developing roller 10C is separated from the photosensitive drum 4C and the driving force is not transmittable to the developing roller 10C. In other words, the condition in the switching assembly 14C is switchable between the first condition and the second condition.

The gear 22K, together with the lever 23K and the clutch 21K, forms a part of a switching assembly 14K. The switching assembly 14K is operable in one of a first condition, in which the developing roller 10K is placed to contact the photosensitive drum 4K and the driving force is transmittable to the developing roller 10K, and a second condition, in which the developing roller 10K is separated from the photosensitive drum 4K and the driving force is not transmittable to the developing roller 10K. In other words, the condition in the switching assembly 14K is switchable between the first condition and the second condition.

2.7 Behaviors of the Switching Assemblies

As shown in FIGS. 5 and 6, the shifting cam 41Y is rotatable between a first position (see FIG. 5) and a second position (see FIG. 6). As the shifting cam 41Y rotates, the switching cam 42Y rotates alongside the shifting cam 41Y, as shown in FIGS. 11 and 12, between a third position (see FIG. 11) and a fourth position (see FIG. 12). The switching cam 42Y is, as shown in FIG. 11, when the shifting cam 41Y is at the first position, located at the third position. When the shifting cam 41Y is at the second position, the switching cam 42Y is located at the fourth position, as shown in FIG. 12.

Specifically, as shown in FIG. 5, when the shifting cam 41Y is at the first position, the rib 122Y in the shifting member 12Y contacts no part of the shifting cam 14Y and faces directly the first face S1 of the gear 22Y. In this arrangement, the shifting member 12Y is located at the contacting position. In other words, when the shifting cam 41 is at the first position, the shifting cam 41Y locates the shifting member 12Y at the contacting position.

In the meantime, as shown in FIG. 11, the switching cam 42Y is located at the third position, with the first circumferential face S21 facing the first end 231Y of the lever 23Y leaving clearance there-between. Therefore, when the switching cam 42Y is at the third position, the lever 23Y is located at the engaged position due to the urging force of the spring, which is not shown. In particular, when the switching cam 42Y is at the third position, the lever 23Y is located at the engaged position to restrict the disk 34Y and the sun gear 311Y from rotating. In other words, when the switching cam 42Y is at the third position, the switching cam 42Y places the clutch 21Y in the transmittable condition. Moreover, when the switching cam 42Y is at the third position, the switching cam 42Y places the switching assembly 14Y in the first condition.

As the shifting cam 41Y rotates from the first position (see FIG. 5) toward the second position (see FIG. 6), the first oblique face S12 contacts the rib 122Y in the shifting member 12Y. Accordingly, the shifting member 12Y urged by the shifting cam 41Y moves in the axial direction along the inclination of the first oblique face S12 from the contacting position to the separating position. In other words, the shifting cam 41Y rotating from the first position toward the second position applies pressure to the shifting member 12Y to move the shifting member 12Y from the contacting position to the separating position.

When the shifting cam 41Y is at the second position, as shown in FIG. 6, the plane face S11 contacts the rib 122Y in the shifting member 12Y to locates the shifting member 12Y at the separating position. In other words, when the shifting cam 41Y is at the second position, the shifting cam 41Y locates the shifting member 12Y at the separating position.

In the meantime, as shown in FIG. 12, the switching cam 42Y is at the fourth position, and the lever 23Y is at the disengaged position. In particular, when the switching cam 42Y is at the fourth position, the lever 23Y is at the disengaged position allowing the disk 34Y and the sun gear 311Y to rotate. In other words, when the switching cam 42Y is at the fourth position, the switching cam 42Y places the clutch 21Y in the discontinuing condition. Moreover, when the switching cam 42Y is at the fourth position, the switching cam 42Y places the switching assembly 14Y in the second condition.

Figure 14:
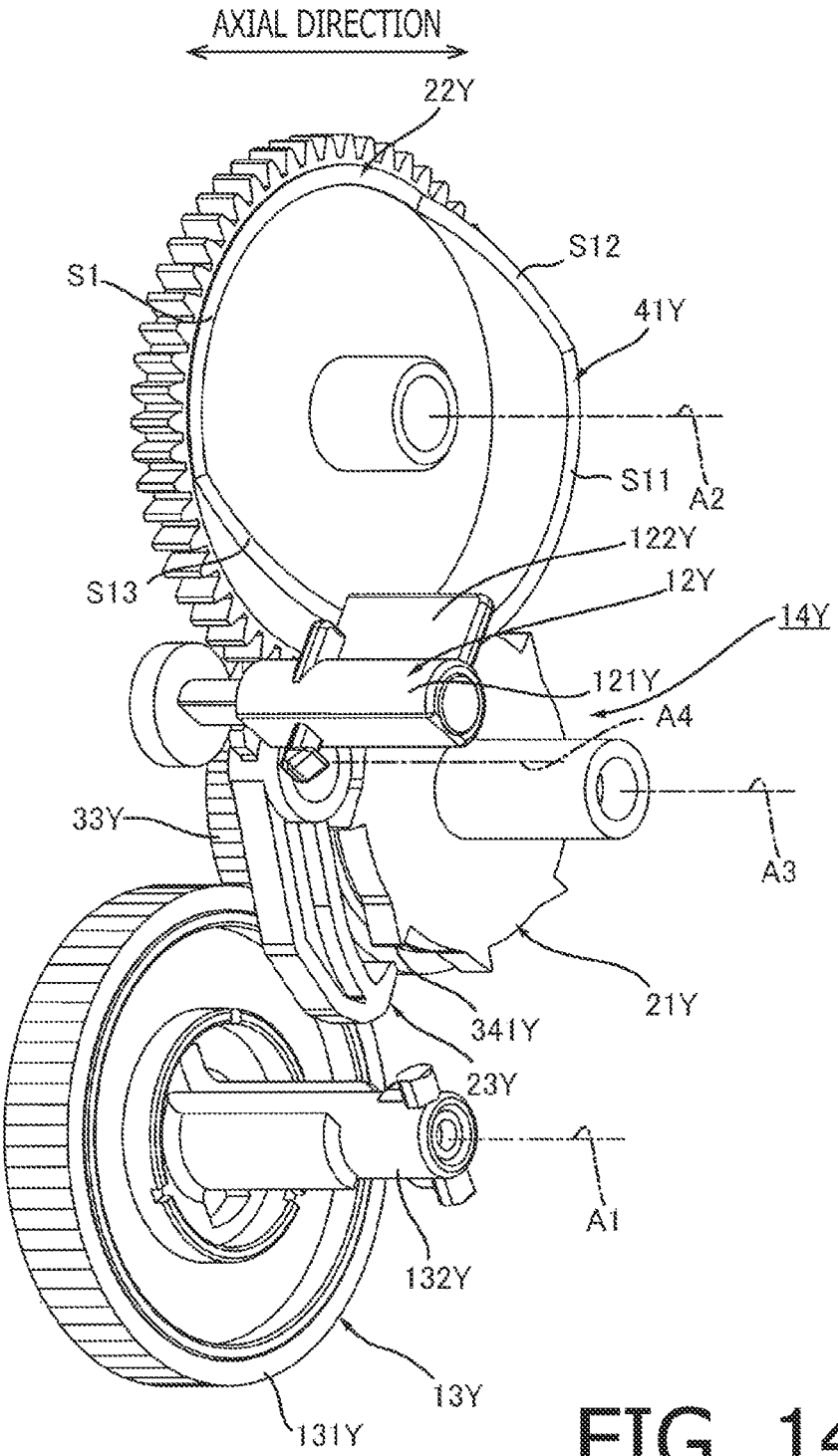
FIG. 14 is a perspective view of the switching assembly being in transition from the second condition to the first condition, with a rib in a shifting member contacting an intermediate portion between a plane face in the shifting cam and a second oblique face, in the image forming apparatus according to the embodiment of the present disclosure.

Moreover, as the shifting cam 41Y rotates from the second position (see FIG. 6) toward the first position (see FIG. 5), as shown in FIG. 14, the rib 122Y in the shifting member 12Y contacts the second oblique face S13. Therefore, the shifting member 12Y moves in the axial direction along the inclination of the second oblique face S13 from the separating position toward the contacting position. Therefore, the shifting cam 41Y rotating from the second position to the first position eases the pressure on the shifting member 12Y. In other words, the shifting member 12Y is released from the pressure from the shifting cam 41Y and is allowed to move from the separating position to the contacting position.

Thereafter, when the shifting cam 41Y is at the first position, as shown in FIG. 5, the shifting member 12Y is located at the contacting position, as described earlier. Meanwhile, as shown in FIG. 11, when the shifting cam 41Y is at the first position, the switching cam 41Y is located at the third position, and the clutch 21Y is placed in the transmittable condition. In other word, the switching assembly 14Y is placed in the first condition.

2.8 Timing for Moving and Activation of the Developing Roller

In the following paragraphs, described with reference to FIGS. 5, 6, 11, 12, and 15 will be timing for moving the developing roller 10Y and activation (rotation) of the developing roller 10Y.

Figure 15:
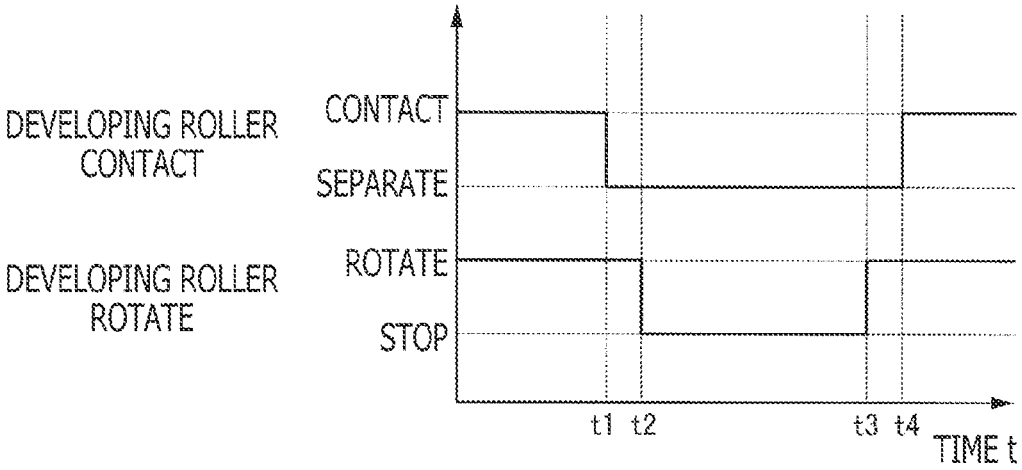
FIG. 15 is a timing chart to illustrate behaviors of the developing roller being activated and deactivated in the image forming apparatus according to the embodiment of the present disclosure.

When the shifting cam 41Y rotates from the first position (see FIG. 5) to the second position (see FIG. 6) and the switching cam 42Y rotates from the third position (see FIG. 11) to the fourth position (FIG. 12), as shown in FIG. 15, at timing t1, the developing roller 10Y separates from the photosensitive drum 4Y. Thereafter, at timing t2, the developing roller 10Y stops rotating. Specifically, the shifting cam 41Y locates the shifting member 12Y at the separating position, thereby the developing roller 10Y is separated from the photosensitive drum 4Y at timing t1. Thereafter, the switching cam 42Y places the clutch 21Y in the discontinuing condition, thereby rotation of the developing roller 10Y is stopped at timing t2.

Further, when the shifting cam 41Y rotates from the second position (see FIG. 6) to the first position (see FIG. 5) and the switching cam 42Y rotates from the fourth position (see FIG. 12) to the third position (see FIG. 11), the developing roller 10Y starts rotating at timing t3. Thereafter, at timing t4, the developing roller 10Y contacts the photosensitive drum 4Y. Specifically, the switching cam 42Y places the clutch 21Y in the transmittable condition, thereby the developing roller 10 is rotated at timing t3. Thereafter, the shifting cam 41Y locates the shifting member 12Y at the contacting position, thereby the developing roller 10Y contacts the photosensitive drum 4Y at timing t4.

Thus, the developing roller 10 may be moved to separate from or contact the photosensitive drum 4Y while the rotation of the developing roller 10 is maintained. Therefore, fluctuation of the load on the motor 11 (see FIG. 3) that may occur when the developing roller 10Y lifts off from and touches down on the photosensitive drum 4Y may be restrained. In this regard, for example, when the developing roller 10K is used for forming an image, and even when the developing roller 10Y is separated from the photosensitive drum 4Y and thereafter moved to contact the photosensitive drum 4Y, defective printing, such as banding may be prevented.

2.9 First Gear Train

The first gear train 15 is, as shown in FIG. 4, a gear train that may transmit the driving force from the motor 11 (see FIG. 3) to the joints 13Y, 13M, 13C, 13K.

Figure 16:
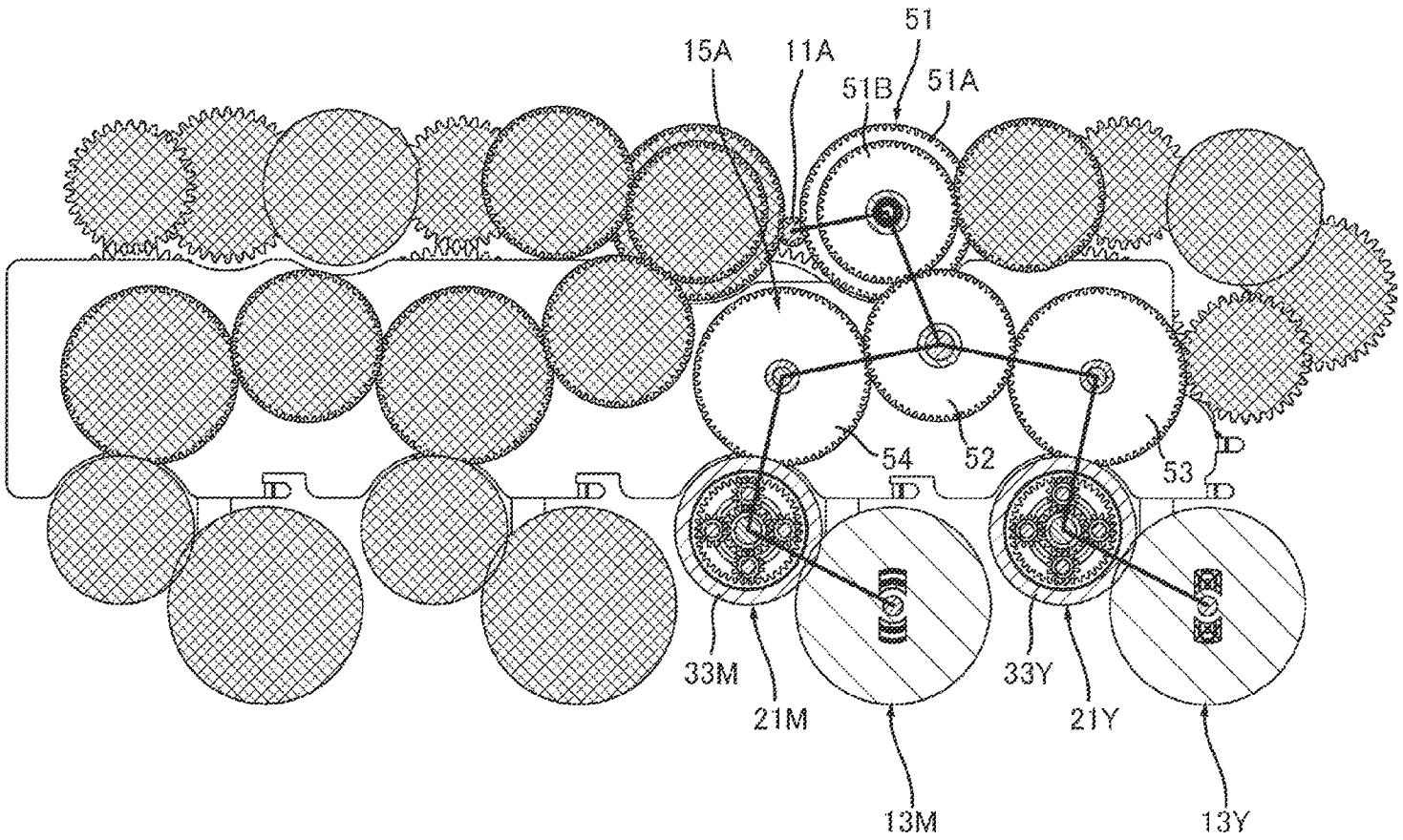
FIG. 16 is an illustrative view of a transmission flow of the force through a third gear train in the image forming apparatus according to the embodiment of the present disclosure.
Figure 17:
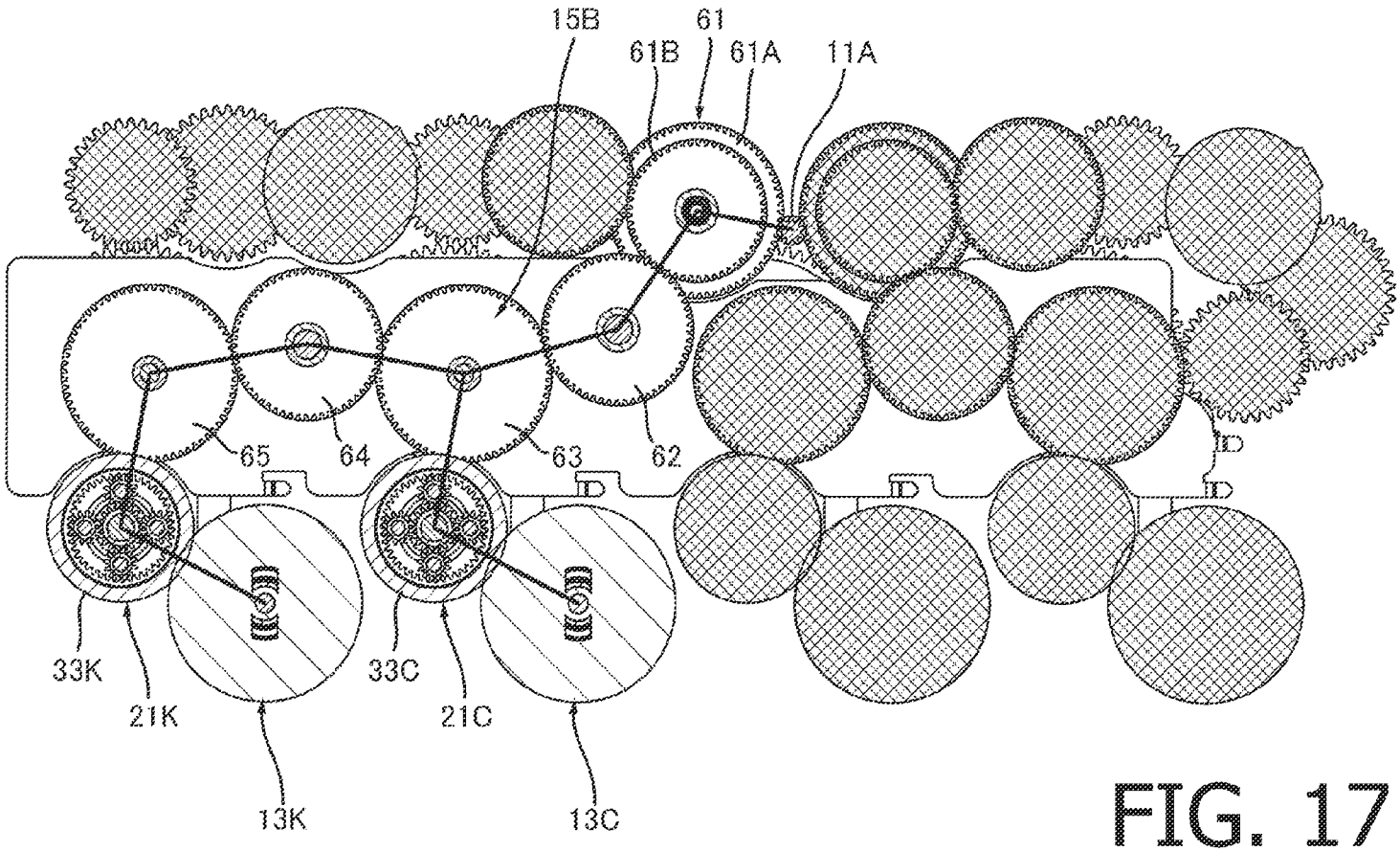
FIG. 17 is an illustrative view of a transmission flow of the force through a fourth gear train in the image forming apparatus according to the embodiment of the present disclosure.

The first gear train 15 includes an output gear 11A, a third gear train 15A (see FIG. 16), and a fourth gear train 15B (see FIG. 17). The third gear train 15A may transmit the driving force, generated in the motor 11, from the output gear 11A to the joints 13Y, 13M. The fourth gear train 15B may transmit the driving force, generated in the motor 11, from the output gear 11A to the joints 13C, 13K.

The output gear 11A is attached to an output shaft of the motor 11 and is rotatable alongside the output shaft of the motor 11.

The third gear train 15A includes, as shown in FIG. 16, the clutches 21Y, 21M described earlier, a two-wheeler gear 51, and idle gears 52, 53, 54. The third gear train 15A transmits the driving force generated in the motor 11 from the output gear 11A to the joint 13Y through the two-wheeler gear 51, the idle gear 52, the idle gear 53, and the clutch 21Y. Simultaneously, the third gear train 15A transmits the driving force generated in the motor 11 from the output gear 11A to the joint 13M through the two-wheeler gear 51, the idle gear 52, the idle gear 54, and the clutch 21M.

The fourth gear train 15B includes, as shown in FIG. 17, the clutches 21C, 21K described earlier, a two-wheeler gear 61, and idle gears 62, 63, 64, 65. The fourth gear train 15B transmits the driving force generated in the motor 11 from the output gear 11A to the joint 13C through the two-wheeler gear 61, the idle gear 62, the idle gear 63, and the clutch 21C. Simultaneously, the fourth gear train 15B transmits the driving force generated in the motor 11 from the output gear 11A to the joint 13K through the two-wheeler gear 61, the idle gear 62, the idle gear 63, the idle gear 64, the idle gear 65, and the clutch 21K.

As shown in FIG. 16, the two-wheeler gear 51 has a larger-diameter gear 51A and a smaller-diameter gear 51B integrally. In other words, the larger-diameter gear 51A and the smaller-diameter gear 51B are integrally rotatable. The larger-diameter gear 51A meshes with the output gear 11A. A diameter of the smaller-diameter gear 51B is smaller than a diameter of the larger-diameter gear 51A. The smaller-diameter gear 51B is rotatable about a same axis as the larger-diameter gear 51A.

The idle gear 52 meshes with the smaller-diameter gear 51B. The idle gear 53 meshes with the idle gear 52. The idle gear 53 further meshes with the first gear 32Y in the clutch 21Y. Therefore, the driving force generated in the motor 11 is transmittable from the output gear 11A to the first gear 32Y in the clutch 21Y through the two-wheeler gear 51, the idle gear 52, and the idle gear 53. Further, when the clutch 21Y is in the transmittable condition, the driving force is transmittable to the joint 13Y through the second gear 33Y rotating in the clutch 21Y. Meanwhile, the idle gear 54 meshes with the idle gear 52 independently from the idle gear 53. The idle gear 54 further meshes with the first gear 32M, which is not shown, in the clutch 21M. Therefore, the driving force generated in the motor 11 is transmittable from the output gear 11A to the first gear 32M in the clutch 21M through the two-wheeler gear 51, the idle gear 52, and the idle gear 54. Further, the driving force is, when the clutch 21M is in the transmittable condition, transmittable to the joint 13M through the second gear 33M rotating in the clutch 21M.

As shown in FIG. 17, the two-wheeler gear 61 has a larger-diameter gear 61A and a smaller-diameter gear 61B integrally. In other words, the larger-diameter gear 61A and the smaller-diameter gear 61B are integrally rotatable. The larger-diameter gear 61A meshes with the output gear 11A independently from the larger-diameter gear 51A in the two-wheeler gear 51. In other words, the fourth gear train 15B is connected with the output gear 11A independently from the third gear train 15A (see FIG. 16). Therefore, the fourth gear train 15B may receive the driving force from the motor 11 independently from the third gear train 15A. A diameter of the smaller-diameter gear 61B is smaller than a diameter of the larger-diameter gear 61A. The smaller-diameter gear 61B is rotatable about a same axis as the larger-diameter gear 61A.

The idle gear 62 meshes with the smaller-diameter gear 61B. The idle gear 63 meshes with the idle gear 62. The idle gear 63 further meshes with the first gear 32C, which is not shown, in the clutch 21C. Therefore, the driving force generated in the motor 11 is transmittable from the output gear 11A to the first gear 32C in the clutch 21C through the two-wheeler gear 61, the idle gear 62, and the idle gear 63. Further, when the clutch 21C is in the transmittable condition, the driving force is transmittable to the joint 13C through the second gear 33C rotating in the clutch 21C. Meanwhile, the idle gear 64 meshes with the idle gear 63. The idle gear 65 meshes with the idle gear 64. The idle gear 65 further meshes with the first gear 32K, which is not shown, in the clutch 21K. Therefore, the driving force generated in the motor 11 is transmittable from the output gear 11A to the first gear 32K in the clutch 21K through the two-wheeler gear 61, the idle gear 62, the idle gear 63, the idle gear 64, and the idle gear 65. Further, the driving force is, when the clutch 21M is in the transmittable condition, transmittable to the joint 13K through the second gear 33K rotating in the clutch 21K.

2.10 Second Gear Train

The second gear train 16 is, as shown in FIG. 3, a gear train that may transmit the driving force from the motor 11 to gears 22Y, 22M, 22C, 22K. In other words, the second gear train 16 may transmit the driving force from the motor 11 to the shifting cams 41Y, 41M, 41C, 41K and to the switching cams 42Y, 42M, 42C, 42K.

Figure 18:
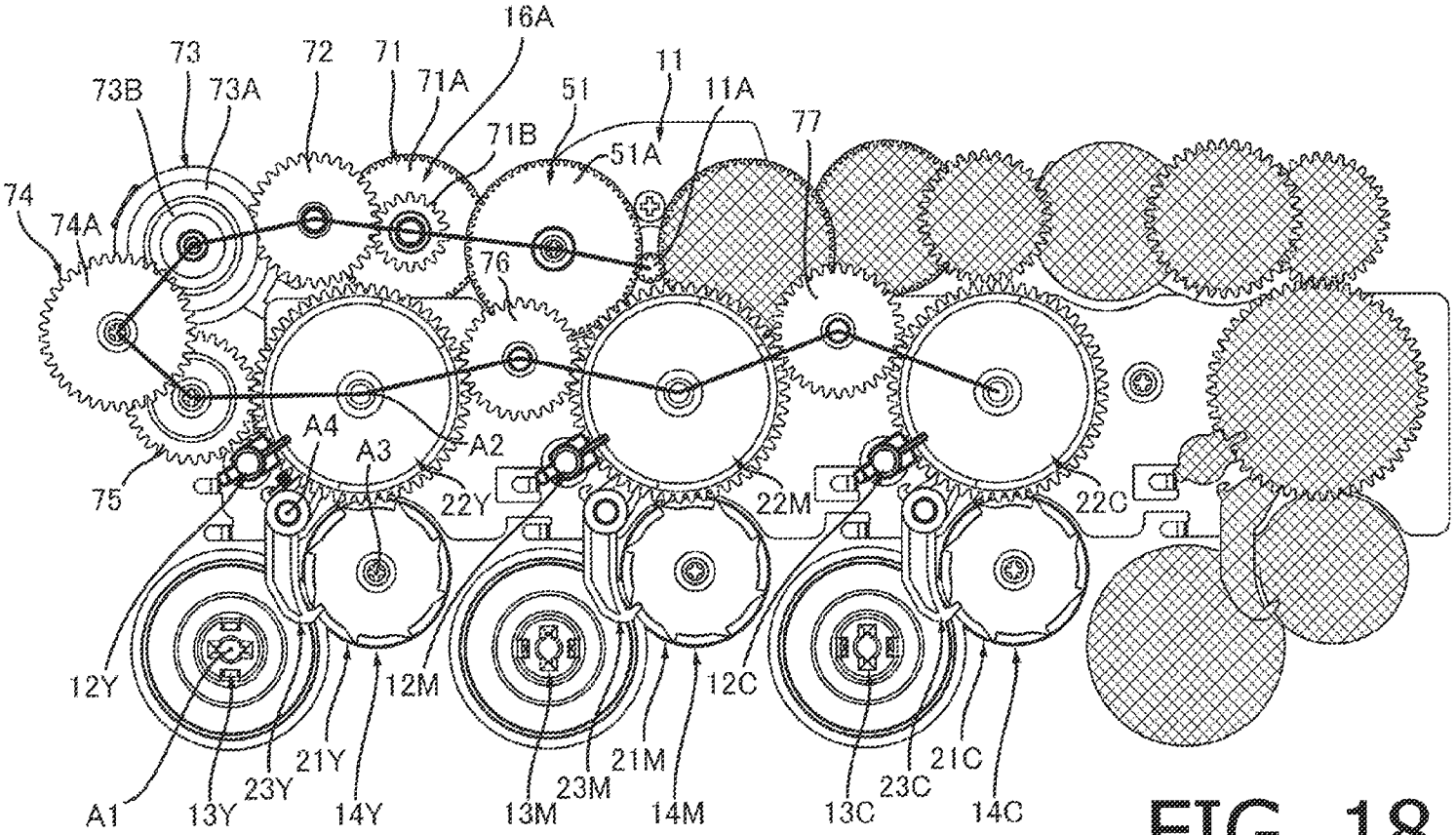
FIG. 18 is an illustrative view of a transmission flow of the force through a fifth gear train in the image forming apparatus according to the embodiment of the present disclosure.
Figure 19:
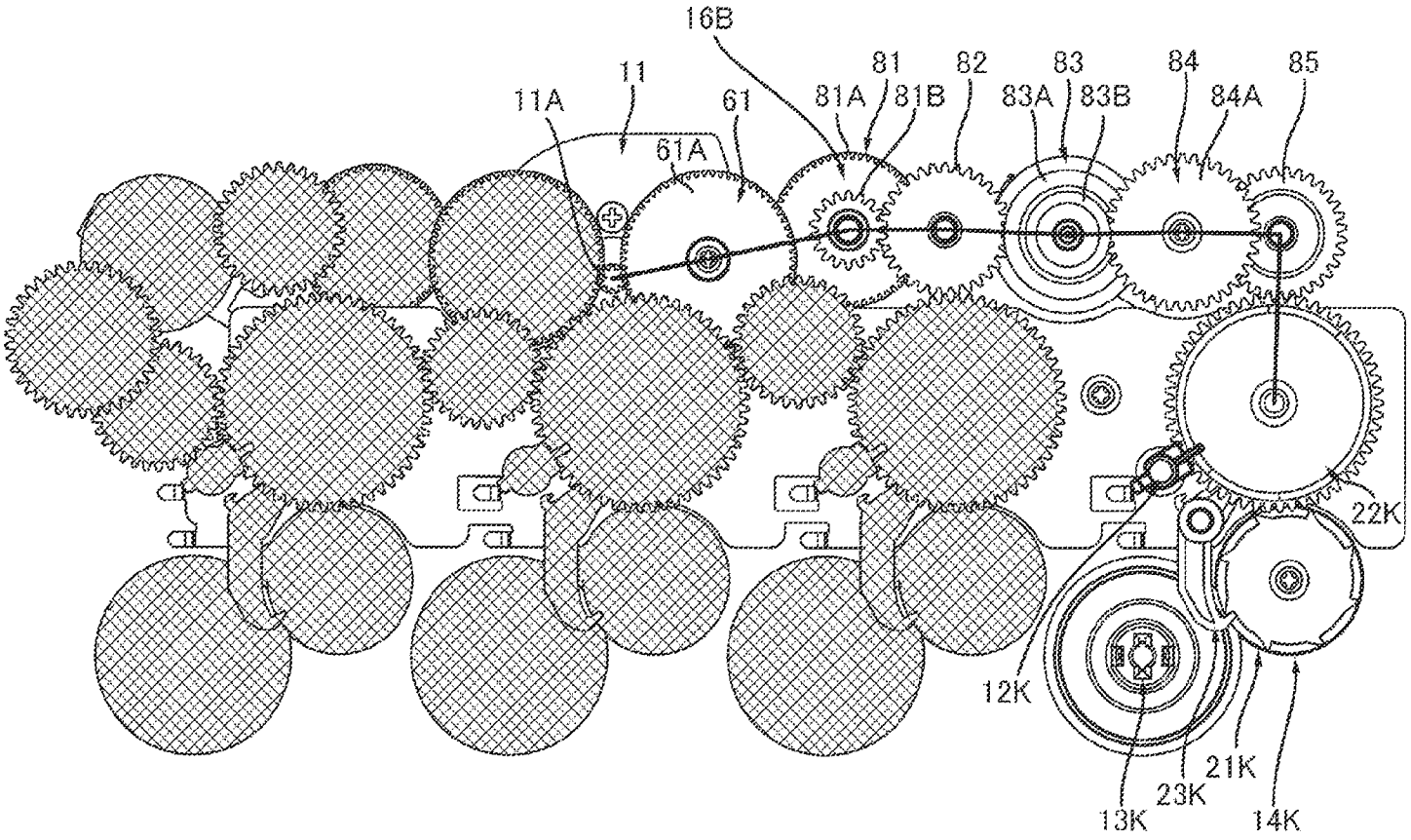
FIG. 19 is an illustrative view of a transmission flow of the force through a sixth gear train in the image forming apparatus according to the embodiment of the present disclosure.

The fourth gear train 16 includes a fifth gear train 16A (see FIG. 18) and a sixth gear train 16B (see FIG. 19). The fifth gear train 16A may transmit the driving force generated in the motor 11 through the two-wheeler gear 51 to the gears 22Y, 22M, 22C. The sixth gear train 16B may transmit the driving force generated in the motor 11 through the two-wheeler gear 61 to the gear 22K.

The fifth gear train 16A includes, as shown in FIG. 18, a two-wheeler gear 71, an idle gear 72, a first electromagnetic clutch 73, a two-wheeler gear 74, an idle gear 75, an idle gear 76, and an idle gear 77. The fifth gear train 16A may transmit the driving force generated in the motor 11 from the two-wheeler gear 51 to the gear 22Y through the two-wheeler gear 71, the idle gear 72, the first electromagnetic clutch 73, the two-wheeler gear 74, and the idle gear 75. In other words, the fifth gear train 16A may transmit the driving force from the motor 11 to the shifting cam 41Y and the switching cam 42Y. Moreover, the fifth gear train 16A may transmit the driving force generated in the motor 11 from the gear 22Y to the gear 22M through the idle gear 76. In other words, the fifth gear train 16A may transmit the driving force generated in the motor 11 to the shifting cam 41M and the switching cam 42M. Moreover, the fifth gear train 16A may transmit the driving force generated in the motor 11 from the gear 22M to the gear 22C through the idle gear 77. In other words, the fifth gear train 16A may transmit the driving force generated in the motor 11 to the shifting cam 41C and the switching cam 42C.

The sixth gear train 16B includes, as shown in FIG. 19, a two-wheeler gear 81, an idle gear 82, a second electromagnetic clutch 83, a two-wheeler gear 84, and an idle gear 85. The sixth gear train 16B may transmit the driving force generated in the motor 11 from the two-wheeler gear 61 to the gear 22K through the two-wheeler gear 81, the idle gear 82, the second electromagnetic clutch 83, the two-wheeler gear 84, and the idle gear 85. In other words, the sixth gear train 16B may transmit the driving force generated in the motor 11 to the shifting cam 41K and the switching cam 42K.

As shown in FIG. 18, the two-wheeler gear 71 has a larger-diameter gear 71A and a smaller-diameter gear 71B integrally. In other words, the larger-diameter gear 71A and the smaller-diameter gear 71B are integrally rotatable. The larger-diameter gear 71A meshes with the smaller-diameter gear 51B (see FIG. 4) in the two-wheeler gear 51 independently from the idle gear 52 (see FIG. 4). A diameter of the smaller-diameter gear 71B is smaller than a diameter of the larger-diameter gear 71A. The smaller-diameter gear 71B is rotatable about a same axis as the larger-diameter gear 71A.

The idle gear 72 meshes with the smaller-diameter gear 71B in the two-wheeler gear 71.

The first electromagnetic clutch 73 includes a gear 73A and a gear 73B. The gear 73A is attached to an armature in the first electromagnetic clutch 73. The gear 73A meshes with the idle gear 72. The gear 73B is attached to a rotor in the first electromagnetic clutch 73. When the first electromagnetic clutch 73 is active, the gear 73B is rotatable alongside the gear 73A. On the other hand, when the first electromagnetic clutch 73 is inactive, the gear 73B is rotatable independently from the gear 73A. In other words, when the first electromagnetic clutch 73 is inactive, and when the gear 73A rotates, the gear 73B may stay still without rotating.

The two-wheeler gear 74 has a larger-diameter gear 74A and a smaller-diameter gear 74B (see FIG. 4) integrally. In other words, the larger-diameter gear 74A and the smaller-diameter gear 74B are integrally rotatable. The larger-diameter gear 74A meshes with the gear 73B in the first electromagnetic cultch 73. A diameter of the smaller-diameter gear 74B is smaller than a diameter of the larger-diameter gear 74A. The smaller-diameter gear 74B is rotatable about a same axis as the larger-diameter gear 74A.

The idle gear 75 meshes with the smaller-diameter gear 74B (see FIG. 4) in the two-wheeler gear 74 and with the gear 22Y. Therefore, the driving force from the motor 11 is, when the first electromagnetic clutch 73 is active, transmittable from the output gear 11A to the gear 22Y through the two-wheeler gear 51, the two-wheeler gear 71, the idle gear 72, the first electromagnetic clutch 73, the two-wheeler gear 74, and the idle gear 75.

The idle gear 76 meshes with the gear 22Y and with the gear 22M. Therefore, the driving force generated in the motor 11 transmitted to the gear 22Y is further transmittable to the gear 22M through the idle gear 76.

The idle gear 77 meshes with the gear 22M and with the gear 22C. Therefore, the driving force generated in the motor 11 transmitted to the gear 22M is further transmittable to the gear 22C through the idle gear 77.

As shown in FIG. 19, the two-wheeler gear 81 has a larger-diameter gear 81A and a smaller-diameter gear 81B integrally. In other words, the larger-diameter gear 81A and the smaller-diameter gear 81B are integrally rotatable. The larger-diameter gear 81A meshes with the smaller-diameter gear 61B (see FIG. 4) in the two-wheeler gear 61 independently from the idle gear 62 (see FIG. 4). While the larger-diameter gear 81A meshes with the smaller-diameter gear 61B in the two-wheeler gear 61, the sixth gear train 16B is connected with the output gear 11A independently from the fifth gear train 16A (see FIG. 18). Therefore, the sixth gear train 16B may receive the driving force from the motor 11 independently from the fifth gear train 16A. A diameter of the smaller-diameter gear 81B is smaller than a diameter of the larger-diameter gear 81A. The smaller-diameter gear 81B is rotatable about a same axis as the larger-diameter gear 81A.

The idle gear 82 meshes with the smaller-diameter gear 81B in the two-wheeler gear 81.

The second electromagnetic clutch 83 includes a gear 83A and a gear 83B. The gear 83A is attached to an armature in the second electromagnetic clutch 83. The gear 83A meshes with the idle gear 82. The gear 83B is attached to a rotor in the second electromagnetic clutch 83. When the second electromagnetic clutch 83 is active, the gear 83B is rotatable alongside the gear 83A. On the other hand, when the second electromagnetic clutch 83 is inactive, the gear 83B is rotatable independently from the gear 83A. In other words, when the second electromagnetic clutch 83 is inactive, and when the gear 83A rotates, the gear 83B may stay still without rotating.

The two-wheeler gear 84 has a larger-diameter gear 84A and a smaller-diameter gear 84B (see FIG. 4) integrally. In other words, the larger-diameter gear 84A and the smaller-diameter gear 84B are integrally rotatable. The larger-diameter gear 84A meshes with the gear 83B in the second electromagnetic cultch 83. A diameter of the smaller-diameter gear 84B is smaller than a diameter of the larger-diameter gear 84A. The smaller-diameter gear 84B is rotatable about a same axis as the larger-diameter gear 84A.

The idle gear 85 meshes with the smaller-diameter gear 84B (see FIG. 4) in the two-wheeler gear 84 and with the gear 22K. Therefore, the driving force from the motor 11 is, when the second electromagnetic clutch 83 is active, transmittable from the output gear 11A to the gear 22K through the two-wheeler gear 61, the two-wheeler gear 81, the idle gear 82, the second electromagnetic clutch 83, the two-wheeler gear 84, and the idle gear 85.

3. Operations in the Image Forming Apparatus

The image forming apparatus 1 is operable in one of a plurality of printing modes including a four-color printing mode, in which an image may be printed in the toners of four (4) colors; a monochrome printing mode, in which an image may be printed in one of the toners; and a three-color printing mode, in which an image may be printed in the toners of three (3) colors. In any of these printing modes, while the image is being formed, the first electromagnetic clutch 73 (see FIG. 3) and the second electromagnetic cutch 83 (see FIG. 3) are both maintained inactive so that the conditions in the switching assemblies 14Y, 14M, 14C, 14K should not be affected. However, when the printing mode is switched from the four-color printing mode to the monochrome printing mode or the three-color printing mode, the conditions in the switching assemblies 14Y, 14M, 14C, 14M may be switched in the manners described below.

In the four-color printing mode, as shown in FIG. 1, the developing roller 10Y contacts the photosensitive drum 4Y, the developing roller 10M contacts the photosensitive drum 4M, the developing roller 10C contacts the photosensitive drum 4C, and the developing roller 10K contacts the photosensitive drum 4K so that the yellow (Y) toner in the developing cartridge 7Y, the magenta (M) toner in the developing cartridge 7M, the cyan (C) toner in the developing cartridge 7C, and the black (K) toner in the developing cartridge 7K may be used to print an image.

In the four-color printing mode, therefore, as shown in FIG. 3, the switching assemblies 14Y, 14M, 14C, 14K are all placed in the first condition, in which the switching assemblies 14Y, 14M, 14C, 14K are enabled to transmit the driving force to the developing rollers 10Y, 10M, 10C, 10K, respectively.

Figure 20:
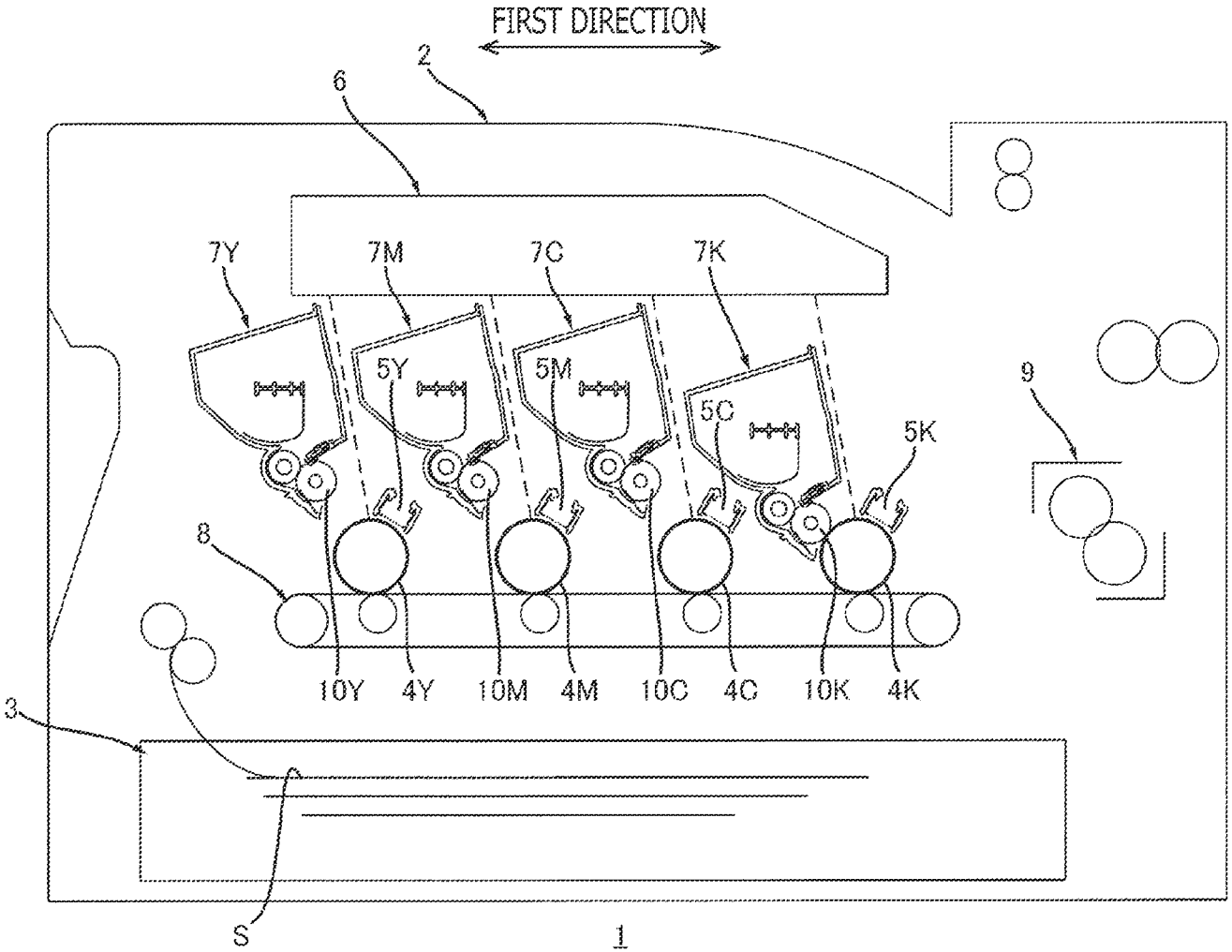
FIG. 20 is an illustrative cross-sectional view of the image forming apparatus being in a monochrome printing mode according to the embodiment of the present disclosure.

In the monochrome printing mode, meanwhile, as shown in FIG. 20, the developing roller 10Y is separated from the photosensitive drum 4Y, the developing roller 10M is separated from the photosensitive drum 4M, and the developing roller 10C is separated from the photosensitive drum 4C, while solely the developing roller 10K contacts the photosensitive drum 4K so that the K toner alone may be used to print an image.

In the monochrome printing mode, the switching assemblies 14Y, 14M, 14C are placed in the second condition, in which the switching assemblies 14Y, 14M, 14C are disabled to transmit the driving force to the developing rollers 10Y, 10M, 10C, respectively; and the switching assembly 14K is placed in the first condition, in which the switching assembly 14K is enabled to transmit the driving force to the developing roller 10K.

When the printing mode is switched from the four-color printing mode to the monochrome printing mode, therefore, the image processing apparatus 1 activates the first electromagnetic clutch 73 (see FIG. 3). Accordingly, the driving force from the motor 11 is transmitted to the gears 22Y, 22M, 22C through the fifth gear train 16A, and the condition in the switching assemblies 14Y, 14M, 14C is switched from the first condition to the second condition. Thereafter, the image forming apparatus 1 deactivates the first electromagnetic clutch 73 (see FIG. 3).

Thus, the switching action to switch the operation mode from the four-color printing mode to the monochrome printing mode is completed.

Figure 21:
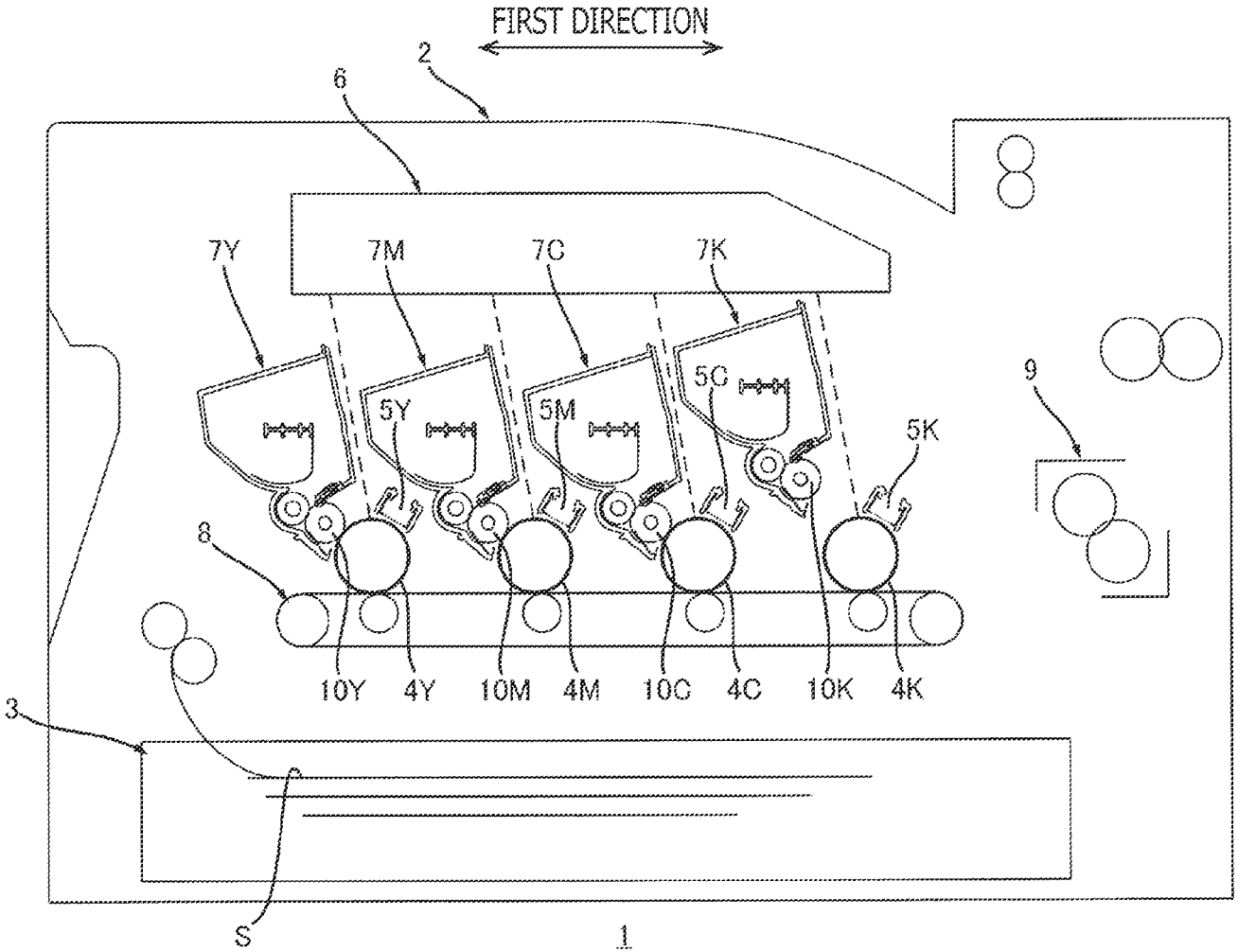
FIG. 21 is an illustrative cross-sectional view of the image forming apparatus being in a three-color printing mode according to the embodiment of the present disclosure.

In the three-color printing mode, as shown in FIG. 21, the developing roller 10Y contacts the photosensitive drum 4Y, the developing roller 10M contacts the photosensitive drum 4M, and the developing roller 10C contacts the photosensitive drum 4C while the developing roller 10K is separated from the photosensitive drum 4K so that the Y toner, the M toner, and the C toner may be used to print an image.

In the three-color printing mode, the switching assemblies 14Y, 14M, 14C are placed in the first condition, in which the switching assemblies 14Y, 14M, 14C are enabled to transmit the driving force to the developing rollers 10Y, 10M, 10C, respectively. On the other hand, the switching assembly 14K is placed in the second condition, in which the switching assembly 14K is disabled to transmit the driving force to the developing roller 10K.

When the printing mode is switched from the four-color printing mode to the three-color printing mode, therefore, the image processing apparatus 1 activates the second electromagnetic clutch 83 (see FIG. 3). Accordingly, the driving force from the motor 11 is transmitted to the gear 22K through the sixth gear train 16B, and the condition in the switching assembly 14K is switched from the first condition to the second condition. Thereafter, the image forming apparatus 1 deactivates the second electromagnetic clutch 83 (see FIG. 3).

Thus, the switching action to switch the operation mode from the four-color printing mode to the three-color printing mode is completed.

4. Benefits

According to the image forming apparatus 1 in the embodiment described above, in the image forming apparatus 1, when the shifting cam 41Y is at the first position and the switching cam 42Y is at the third position, as shown in FIGS. 5 and 11, the shifting member 12Y is located at the contacting position, and the clutch 21Y is placed in the transmittable condition.

Thereby, while the developing roller 10Y contacts the photosensitive drum 4Y, the driving force from the motor 11 may be transmitted to the developing roller 10Y.

On the other hand, when the shifting cam 41Y is at the second position and the switching cam 42Y is at the fourth position, as shown in FIGS. 6 and 12, the shifting member 12Y is located at the separating position, and the clutch 21Y is placed in the discontinuing condition.

Thus, while the developing roller 10Y is separated from the photosensitive drum 4Y, the driving force from the motor 11 is discontinued in the clutch 21Y without being transmitted further to the developing roller 10Y.

Therefore, while the developing roller 10Y is separated from the photosensitive drum 4Y, the developing roller 10 may stop rotating.

Moreover, the image forming apparatus 1 includes the gear 22Y, as shown in FIGS. 13A and 13B, in which the shifting cam 41 and the switching cam 42Y are integrally arranged.

Therefore, the rotation of the switching cam 42Y may be accompanied by rotation of the shifting cam 41Y reliably.

Accordingly, the timing when the developing roller 10Y is separated from the photosensitive drum 4Y and the timing when the developing roller 10Y stops rotating may be separated reliably.

Moreover, in the image forming apparatus 1, as shown in FIGS. 3 and 4, the third gear train 15A to transmit the driving force from the motor 11 to the joint 13Y and the joint 13M and the fourth gear train 15B to transmit the driving force from the motor 11 to the joint 13C and the joint 13K are independent from each other.

Therefore, the fluctuation of the torques in the joint 13Y and the joint 13M may not be transmitted to the fourth gear train 15B, in other words, may not affect rotations of the developing roller 10C and the developing roller 10K.

Meanwhile, the fluctuation of the torques in the joint 13C and the joint 13K may not be transmitted to the third gear train 15A, in other words, may not affect the rotations of the developing roller 10Y and the developing roller 10M.

Therefore, disturbance in the printing operation due to the fluctuation of the torques in the joints 13Y, 13M, 13C, 13K may be restrained.

Moreover, in the image forming apparatus 1, the fifth gear train 16A to transmit the driving force from the motor 11 to the shifting cams 41Y, 41M, 41C, and to the switching cam 42Y, 42M, 42C and the sixth gear train 16B to transmit the driving force from the motor 11 to the shifting cam 41K and to the switching cam 42K are independent from each other.

Therefore, the printing mode in the image forming apparatus 1 may be selectively switched among the four-color printing mode, the monochrome printing mode, and the three-color printing mode.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

5. More Examples

With reference to FIGS. 22A and 22B, described below will be examples that may be modified from the embodiment described above. In the examples described below, items or structures which are identical or equivalent to those described in the previous embodiment may be referred to by the same reference signs, and explanation of those may be omitted.

The timing to move the developing roller 10Y and to start rotating the developing roller 10Y may not necessarily be limited to those as described in the previous embodiment.

For example, when the shifting cam 41Y rotates from the first position (see FIG. 5) to the second position (see FIG. 6) and the switching cam 42Y moves from the third position (see FIG. 11) to the fourth position (see FIG. 12), the developing roller 10Y may be separated from the photosensitive drum 4Y after the developing roller 10 stops rotating, as shown in FIG. 22A.

Further, when the shifting cam 41Y rotates from the second position (see FIG. 6) to the first position (see FIG. 5) and the switching cam 42Y moves from the fourth position (see FIG. 12) to the third position (see FIG. 11), the developing roller 10Y may contact the photosensitive drum 4Y after the developing roller 10 starts rotating.

For another example, as shown in FIG. 22B, when the shifting cam 41Y rotates from the first position (see FIG. 5) to the second position (see FIG. 6) and the switching cam 42Y moves from the third position (see FIG. 11) to the fourth position (see FIG. 12), the rotation of the developing roller 10Y may be stopped at the same time when the developing roller 10Y is separated from the photosensitive drum 4Y.

Further, when the shifting cam 41Y rotates from the second position (see FIG. 6) to the first position (see FIG. 5) and the switching cam 42Y moves from the fourth position (see FIG. 12) to the third position (see FIG. 11), the developing roller 10Y may start rotating at the same time when the developing roller 10Y contacts the photosensitive drum 4Y.

What is claimed is:

1. An image forming apparatus, comprising:

a first photosensitive drum;

a first developing roller rotatable about a first axis extending in an axial direction;

a first shifting member configured to move in the axial direction between a contacting position, in which the first developing roller contacts the first photosensitive drum, and a separating position, in which the first developing roller is separated from the first photosensitive drum;

a motor; and a first shifting cam configured to move the first shifting member in the axial direction, the first shifting cam being configured to rotate about a second axis extending in the axial direction by a driving force received from the motor, the first shifting cam being configured to rotate between a first position, in which the first shifting cam locates the first shifting member at the contacting position, and a second position, in which the first shifting cam locates the first shifting member at the separating position.

2. The image forming apparatus according to claim 1, further comprising:

a first joint configured to transmit the driving force from the motor to the first developing roller, the first joint comprising a first joint gear configured to receive the driving force from the motor, the first joint being configured to rotate about the first axis by the driving force received by the first joint gear.

3. The image forming apparatus according to claim 2, further comprising:

a first clutch configured to operate in one of a transmittable condition, in which the first clutch is transmittable of the driving force from the motor to the first joint gear, and a discontinuing condition, in which the first clutch discontinues transmission of the driving force from the motor to the first joint gear; and a first switching cam configured to switch the conditions in the first clutch, the first switching cam being configured to rotate about the second axis alongside the first shifting cam, the first switching cam being configured to rotate between a third position, in which the first switching cam places the first clutch in the transmittable condition, and a fourth position, in which the first switching cam places the first clutch in the discontinuing condition, the first switching cam being configured to be located at the third position in a state where the first shifting cam is located at the first position and configured to be located at the fourth position in a state where the first shifting cam is located at the second position.

4. The image forming apparatus according to claim 1, further comprising:

a first clutch configured to operate in one of a transmittable condition, in which the first clutch allows transmission of the driving force from the motor to the first developing roller, and a discontinuing condition, in which the first clutch discontinues transmission of the driving force from the motor to the first developing roller; and a first switching cam configured to switch the conditions in the first clutch, the first switching cam being configured to rotate about the second axis alongside the first shifting cam, the first switching cam being configured to rotate between a third position, in which the first switching cam places the first clutch in the transmittable condition, and a fourth position, in which the first switching cam places the first clutch in the discontinuing condition, the first switching cam being configured to be located at the third position in a state where the first shifting cam is located at the first position and configured to be located at the fourth position in a state where the first shifting cam is located at the second position.

5. The image forming apparatus according to claim 4, wherein the first clutch comprises:

a planetary gear assembly comprising:

a sun gear configured to rotate about a third axis extending in the axial direction;

a planet gear meshing with the sun gear;

a planet gear carrier supporting the planet gear, the planet gear carrier being configured to rotate about the third axis; and an internal teeth gear meshing with the planet gear, the internal teeth gear being configured to rotate about the third axis;

a first gear configured to rotate alongside the internal teeth gear about the third axis by the driving force received from the motor;

a second gear configured to rotate alongside the planet gear carrier about the third axis, the second gear meshing with a joint gear configured to receive the driving force from the motor; and a disk configured to rotate alongside the sun gear about the third axis, the disk including a claw, and wherein the image forming apparatus further comprises a lever, the lever being configured to move between an engaged position, in which the lever is engaged with the claw, and a disengaged position, in which the lever is disengaged from the claw, the lever being configured to be located at the engaged position and restrict the disk and the sun gear from rotating when the first switching cam is located at the third position, the lever being configured to be located at the disengaged position and allow the disk and the sun gear to rotate when the first switching cam is located at the fourth position.

6. The image forming apparatus according to claim 4, further comprising:

a second photosensitive drum;

a third photosensitive drum;

a fourth photosensitive drum;

a second developing roller;

a third developing roller;

a fourth developing roller;

a second shifting member configured to move between a contacting position, in which the second developing roller contacts the second photosensitive drum, and a separating position, in which the second developing roller is separated from the second photosensitive drum;

a third shifting member configured to move between a contacting position, in which the third developing roller contacts the third photosensitive drum, and a separating position, in which the third developing roller is separated from the third photosensitive drum;

a fourth shifting member configured to move between a contacting position, in which the fourth developing roller contacts the fourth photosensitive drum, and a separating position, in which the fourth developing roller is separated from the fourth photosensitive drum;

a second clutch configured to operate in one of a transmittable condition, in which the second clutch allows transmission of the driving force from the motor to the second developing roller, and a discontinuing condition, in which the second clutch discontinues transmission of the driving force from the motor to the second developing roller;

a third clutch configured to operate in one of a transmittable condition, in which the third clutch allows transmission of the driving force from the motor to the third developing roller, and a discontinuing condition, in which the third clutch discontinues transmission of the driving force from the motor to the third developing roller;

a fourth clutch configured to operate in one of a transmittable condition, in which the fourth clutch allows transmission of the driving force from the motor to the fourth developing roller, and a discontinuing condition, in which the fourth clutch discontinues transmission of the driving force from the motor to the fourth developing roller;

a second shifting cam configured to move the second shifting member;

a third shifting cam configured to move the third shifting member;

a fourth shifting cam configured to move the fourth shifting member;

a second switching cam configured to switch the conditions in the second clutch;

a third switching cam configured to switch the conditions in the third clutch; and a fourth switching cam configured to switch the conditions in the fourth clutch.

7. The image forming apparatus according to claim 6, further comprising:

a first gear train configured to transmit the driving force from the motor to the first developing roller, the second developing roller, the third developing roller, and the fourth developing roller; and a second gear train configured to transmit the driving force from the motor to the first shifting cam, the second shifting cam, the third shifting cam, the fourth shifting cam, the first switching cam, the second switching cam, the third switching cam, and the fourth switching cam, wherein the first gear train includes:

a third gear train configured to transmit the driving force from the motor to the first developing roller and the second developing roller; and a fourth gear train configured to transmit the driving force from the motor to the third developing roller and the fourth developing roller independently from the third gear train, and wherein the second gear train includes:

a fifth gear train configured to transmit the driving force from the motor to the first shifting cam, the second shifting cam, the third shifting cam, the first switching cam, the second switching cam, and the third switching cam; and a sixth gear train configured to transmit the driving force from the motor to the fourth shifting cam and the fourth switching cam independently from the fifth gear train.

8. The image forming apparatus according to claim 7, wherein the third gear train includes the first clutch and the second clutch, wherein the fourth gear train includes the third clutch and the fourth clutch, wherein the fifth gear train includes a first electromagnetic clutch, and wherein the sixth gear train includes a second electromagnetic clutch.

* * * * *